US007512373B2

(12) United States Patent
Shimizu

(10) Patent No.: US 7,512,373 B2
(45) Date of Patent: Mar. 31, 2009

(54) IMAGE FORMING APPARATUS AND DEVELOPER SUPPLIER CAPABLE OF SUPPLYING DEVELOPER AT INCREASED SPEED

(75) Inventor: Misaki Shimizu, Sagamihara (JP)

(73) Assignee: Ricoh Company Ltd., Tokyo (JP)

( * ) Notice: Subject to any disclaimer, the term of this patent is extended or adjusted under 35 U.S.C. 154(b) by 426 days.

(21) Appl. No.: 11/521,559

(22) Filed: Sep. 15, 2006

(65) Prior Publication Data

US 2007/0071502 A1 Mar. 29, 2007

(30) Foreign Application Priority Data

Sep. 15, 2005 (JP) ..... 2005-269285

(51) Int. Cl.
*G03G 15/08* (2006.01)

(52) U.S. Cl. ..... 399/358

(58) Field of Classification Search ..... 399/258, 399/262, 263

See application file for complete search history.

(56) References Cited

U.S. PATENT DOCUMENTS

| | | | | |
|---|---|---|---|---|
| 5,139,176 | A * | 8/1992 | Reindl et al. | |
| 5,441,177 | A | 8/1995 | Yanagisawa | |
| 5,585,899 | A * | 12/1996 | Palumbo et al. | 399/258 |
| 6,711,375 | B1 * | 3/2004 | Itoh | 399/258 |
| 6,898,407 | B2 | 5/2005 | Noguchi et al. | |
| 7,016,629 | B2 | 3/2006 | Ishii et al. | |
| 7,106,995 | B2 * | 9/2006 | Nagai et al. | 399/258 |
| 7,162,189 | B2 | 1/2007 | Tsuda et al. | |
| 7,263,309 | B2 | 8/2007 | Noguchi et al. | |
| 7,333,749 | B2 | 2/2008 | Noguchi et al. | |
| 2001/0050706 | A1 * | 12/2001 | Ishii | |
| 2004/0126150 | A1 | 7/2004 | Noguchi et al. | |
| 2004/0208676 | A1 | 10/2004 | Ishii et al. | |

(Continued)

FOREIGN PATENT DOCUMENTS

JP 2000-258986 9/2000

(Continued)

OTHER PUBLICATIONS

U.S. Appl. No. 11/220,845, filed Sep. 8, 2005, Tsuda, et al.

(Continued)

*Primary Examiner*—Susan S Lee
(74) *Attorney, Agent, or Firm*—Oblon, Spivak, McClelland, Maier & Neustadt, P.C.

(57) ABSTRACT

An image forming apparatus includes an image forming mechanism configured to contain a developer and to form an image with the developer and a developer supplier configured to supply the developer to the image forming mechanism. The developer supplier includes a developer container, a conveyer, a sensor, an agitator, and a driver. The developer container contains the developer. The conveyer conveys the developer from the developer container to the image forming mechanism. The sensor is disposed at a predefined position on an interior wall of the developer container and detects the developer at the predefined position in the developer container. The agitator rotates to agitate the developer and includes a paddle formed in a plate-like shape and including an opening through which a part of the developer slips and avoids being paddled by the paddle. The driver drives the conveyer and the agitator at a variable speed.

16 Claims, 18 Drawing Sheets

U.S. PATENT DOCUMENTS

| | | | |
|---|---|---|---|
| 2005/0281590 | A1 | 12/2005 | Tsuda et al. |
| 2006/0034642 | A1 | 2/2006 | Taguchi et al. |
| 2006/0051136 | A1 | 3/2006 | Tsuda et al. |
| 2006/0083555 | A1 | 4/2006 | Uchiyama et al. |
| 2007/0071502 | A1 | 3/2007 | Shimizu |

FOREIGN PATENT DOCUMENTS

| | | |
|---|---|---|
| JP | 2002-268368 | 9/2002 |
| JP | 3506560 | 12/2003 |
| JP | 2004-139031 | 5/2004 |
| JP | 2004-220012 | 8/2004 |

OTHER PUBLICATIONS

U.S. Appl. No. 11/203,964, filed Aug. 16, 2005, Taguchi, et al.
U.S. Appl. No. 11/247,269, filed Oct. 12, 2005, Uchiyama, et al.
U.S. Appl. No. 11/521,559, filed Sep. 15, 2006, Shimizu.
U.S. Appl. No. 12/186,906, filed Aug. 6, 2008, Someya, et al.

* cited by examiner

IMAGE FORMING APPARATUS AND DEVELOPER SUPPLIER CAPABLE OF SUPPLYING DEVELOPER AT INCREASED SPEED

CROSS-REFERENCE TO RELATED APPLICATION

The present application is based on and claims priority to Japanese patent application No. 2005-269285 filed on Sep. 15, 2005 in the Japan Patent Office, the entire contents of which are hereby incorporated herein by reference.

BACKGROUND

1. Field of the Invention

Exemplary aspects of the present invention relate to an image forming apparatus and a developer supplier, and more particularly to an image forming apparatus and a developer supplier for supplying a developer to be used for image forming at an increased speed.

2. Description of the Related Art

A related art image forming apparatus, such as a copying machine, a printer, a facsimile machine, or a multifunction printer including copying, printing, scanning, and facsimile functions, forms an electrostatic latent image on a photoconductor according to image data. The electrostatic latent image is developed with a developer (e.g., a toner) supplied from a development unit opposing the photoconductor to form a toner image on the photoconductor. The toner image is transferred onto a recording medium to form an image on the recording medium.

The toner to be used for development is supplied from a bottle containing the toner to a developer container of the development unit via a developer supplier. The developer supplier includes a temporary container for temporarily containing the toner supplied from the bottle and a conveyer for rotating to convey the toner in the temporary container toward the developer container. The developer supplier supplies the toner to the developer container to replenish it whenever the toner in the developer container is consumed for development. When the temporary container does not contain a sufficient amount of toner and thereby does not stably supply the toner to the developer container, the electrostatic latent image formed on the photoconductor may not be properly developed and a faulty image may be formed on the recording medium due to improper toner density.

To detect whether the temporary container contains the sufficient amount of toner or not, an exemplary developer supplier includes a sensor for detecting the toner at a specific height in the temporary container. When the sensor does not detect the toner at the specific height, the image forming apparatus notifies a user that the temporary container is almost empty and prompts the user to replace the bottle with new one. Therefore, the user may set the new bottle in the image forming apparatus before the temporary container becomes empty, preventing the faulty image from being formed on the recording medium due to improper toner density.

Another exemplary developer supplier includes an agitator for agitating the toner in the temporary container so as to prevent the toner from agglomerating and a driver for driving the conveyer and the agitator.

To form the image on the recording medium faster, the developer supplier needs to supply the toner to the development unit at an increased speed. When the conveyer is rotated at the increased speed to convey the toner faster, the agitator is also rotated at that increased speed because both the conveyer and the agitator are driven by the common driver.

The toner used in the image forming apparatus has a high flowability (i.e., a low accelerated agglomeration) so as to be conveyed at the increased speed. When the agitator is rotated at the increased speed, the agitator excessively agitates the toner in the temporary container. The toner is excessively dispersed in the air and is stirred up in the temporary container, and an amount of toner per unit volume decreases. The sensor detects the toner based on a load applied to the sensor by the toner. The excessively dispersed toner applies a decreased load to the sensor. Thus, the sensor may erroneously detect that the temporary container is almost empty even when the temporary container contains the sufficient amount of toner.

SUMMARY

This specification describes below an image forming apparatus according to an exemplary embodiment of the invention. In one aspect of the present invention, the image forming apparatus includes an image forming mechanism configured to contain a developer and to form an image with the developer and a developer supplier configured to supply the developer to the image forming mechanism. The developer supplier includes a developer container, a conveyer, a sensor, an agitator, and a driver. The developer container is configured to contain the developer. The conveyer is configured to convey the developer from the developer container to the image forming mechanism. The sensor is disposed at a predefined position on an interior wall of the developer container and is configured to detect the developer at the predefined position in the developer container. The agitator is configured to rotate to agitate the developer, and includes a paddle formed in a plate-like shape and including an opening through which a part of the developer slips and avoids being paddled by the paddle. The driver is configured to drive the conveyer and the agitator at a variable speed.

This specification further describes a developer supplier according to one exemplary embodiment of the invention. In one aspect of the present invention, the developer supplier is configured to supply a developer to an image forming mechanism and includes a developer container, a conveyer, a sensor, an agitator, and a driver. The developer container is configured to contain the developer. The conveyer is configured to convey the developer from the developer container to the image forming mechanism. The sensor is disposed at a predefined position on an interior wall of the developer container and is configured to detect the developer at the predefined position in the developer container. The agitator is configured to rotate to agitate the developer, and includes a paddle formed in a plate-like shape which itself includes an opening through which a part of the developer slips and avoids being paddled by the paddle. The driver is configured to drive the conveyer and the agitator at a variable speed.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
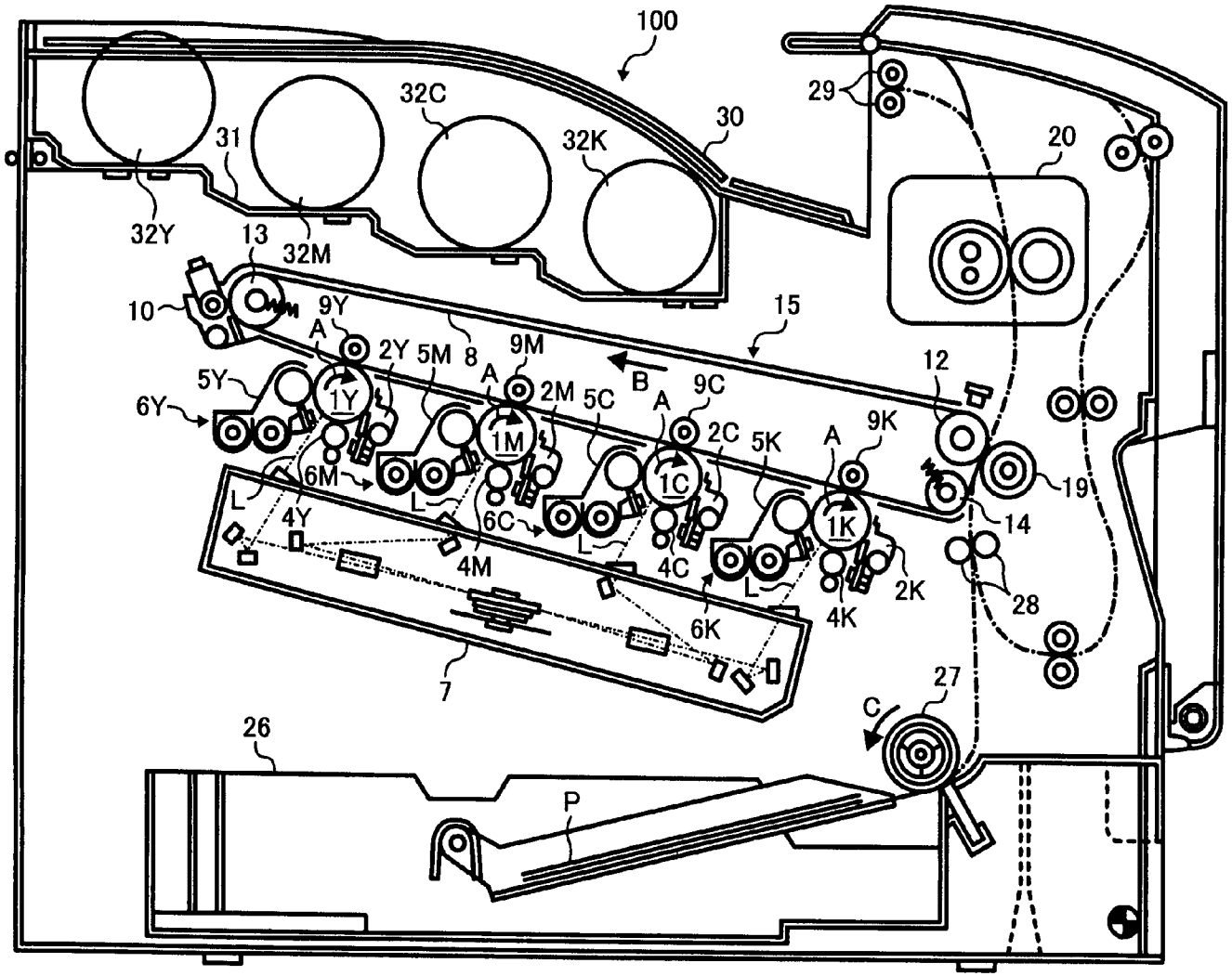
FIG. 1 is a schematic view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, an image forming apparatus 100 according to an exemplary embodiment of the present invention is explained.

As illustrated in FIG. 1, the image forming apparatus 100 includes process cartridges 6Y, 6M, 6C, and 6K, an exposure unit 7, an intermediate transfer unit 15, a toner bottle base 31, toner bottles 32Y, 32M, 32C, and 32K, a paper tray 26, a feeding roller 27, a registration roller pair 28, a second transfer roller 19, a fixing unit 20, an output roller pair 29, and an output tray 30.

The image forming apparatus 100 includes a copying machine, a facsimile machine, a printer, and a multifunction printer including copying, printing, scanning, and facsimile functions. According to this non-limiting exemplary embodiment of the present invention, the image forming apparatus 100 functions as a color printer for printing an image on a recording medium in an electrophotographic method.

The process cartridge 6Y includes a photoconductor 1Y, a charger 4Y, a development unit 5Y, and a cleaner 2Y. The process cartridge 6M includes a photoconductor 1M, a charger 4M, a development unit 5M, and a cleaner 2M. The process cartridge 6C includes a photoconductor 1C, a charger 4C, a development unit 5C, and a cleaner 2C. The process cartridge 6K includes a photoconductor 1K, a charger 4K, a development unit 5K, and a cleaner 2K.

The process cartridges 6Y, 6M, 6C, and 6K respectively form toner images in yellow, magenta, cyan, and black colors. The process cartridges 6Y, 6M, 6C, and 6K are attachable to and detachable from the image forming apparatus 100 so as to be replaced with new ones. The process cartridges 6Y, 6M, 6C, and 6K use as a developer toners of different colors from each other but have a common structure.

The photoconductors 1Y, 1M, 1C, and 1K rotate in a rotating direction A. The chargers 4Y, 4M, 4C, and 4K, the development units 5Y, 5M, 5C, and 5K, and the cleaners 2Y, 2M, 2C, and 2K are respectively disposed around the photoconductors 1Y, 1M, 1C, and 1K. The chargers 4Y, 4M, 4C, and 4K uniformly charge surfaces of the photoconductors 1Y, 1M, 1C, and 1K respectively.

The exposure unit 7 is disposed under the process cartridges 6Y, 6M, 6C, and 6K and emits light L (e.g., a laser beam) onto each of the charged surfaces of the photoconductors 1Y, 1M, 1C, and 1K according to image data so as to form an electrostatic latent image on each of the surfaces of the photoconductors 1Y, 1M, 1C, and 1K. In the exposure unit 7, the laser beam emitted from a light source is scanned by a polygon mirror rotatably driven by a motor and is irradiated onto the surfaces of the photoconductors 1Y, 1M, 1C, and 1K via a plurality of optical lenses and mirrors.

The development units 5Y, 5M, 5C, and 5K respectively develop the electrostatic latent images formed on the surfaces of the photoconductors 1Y, 1M, 1C, and 1K with yellow, magenta, cyan, and black toners to form yellow, magenta, cyan, and black toner images.

The intermediate transfer unit 15 is disposed above the process cartridges 6Y, 6M, 6C, and 6K and includes an intermediate transfer belt 8, a second transfer backup roller 12, a cleaning backup roller 13, a tension roller 14, first transfer bias rollers 9Y, 9M, 9C, and 9K, and a cleaner 10. The intermediate transfer belt 8 is formed in an endless belt-like shape and is looped over the second transfer backup roller 12, the cleaning backup roller 13, and the tension roller 14. At least one of the second transfer backup roller 12, the cleaning backup roller 13, and the tension roller 14 drives and rotates the intermediate transfer belt 8 in a rotating direction B. The first transfer bias rollers 9Y, 9M, 9C, and 9K respectively oppose the photoconductors 1Y, 1M, 1C, and 1K via the intermediate transfer belt 8 to form first transfer nips. A transfer bias of a polarity (e.g., positive) opposite to a polarity of the toner is applied to an inner circumferential surface of the intermediate transfer belt 8. The rollers other than the first transfer bias rollers 9Y, 9M, 9C, and 9K are grounded. The first transfer bias rollers 9Y, 9M, 9C, and 9K respectively transfer and superimpose the yellow, magenta, cyan, and black toner images formed on the surfaces of the photoconductors 1Y, 1M, 1C, and 1K onto an outer circumferential surface of the rotating intermediate transfer belt 8 at the first transfer nips. Thus, a color toner image is formed on the outer circumferential surface of the intermediate transfer belt 8.

The cleaners 2Y, 2M, 2C, and 2K respectively remove residual toners remaining on the surfaces of the photoconductors 1Y, 1M, 1C, and 1K after the yellow, magenta, cyan, and black toner images formed on the surfaces of the photoconductors 1Y, 1M, 1C, and 1K are respectively transferred onto the outer circumferential surface of the intermediate transfer belt 8. Then, dischargers (not shown) discharge the surfaces of the photoconductors 1Y, 1M, 1C, and 1K. Thus, the surfaces of the photoconductors 1Y, 1M, 1C, and 1K are initialized to become ready for next image forming processing.

The toner bottle base 31 is disposed above the intermediate transfer unit 15 and under the output tray 30. The toner bottles 32Y, 32M, 32C, and 32K are arranged on the toner bottle base 31 and respectively contain the yellow, magenta, cyan, and black toners. The yellow, magenta, cyan, and black toners are respectively supplied from the toner bottles 32Y, 32M, 32C, and 32K to the development units 5Y, 5M, 5C, and 5K of the process cartridges 6Y, 6M, 6C, and 6K. The toner bottles 32Y, 32M, 32C, and 32K are attachable to and detachable from the image forming apparatus 100 separately from the process cartridges 6Y, 6M, 6C, and 6K.

The paper tray 26 is disposed under the exposure unit 7 and loads a recording medium (e.g., sheets P). The feeding roller 27 contacts an uppermost sheet P of the sheets P. When a driver (not shown) rotates the feeding roller 27 in a rotating direction C, the uppermost sheet P is fed toward a nip formed by the registration roller pair 28. The registration roller pair 28 rotates to nip the uppermost sheet P. When the registration roller pair 28 nips the uppermost sheet P, the registration roller pair 28 temporarily stops rotating.

The second transfer backup roller 12 opposes the second transfer roller 19 via the intermediate transfer belt 8 to form a second transfer nip. The registration roller pair 28 feeds the sheet P to the second transfer nip at a timing when the color toner image formed on the outer circumferential surface of the intermediate transfer belt 8 is properly transferred onto the sheet P at the second transfer nip. The second transfer roller 19 transfers the color toner image formed on the outer circumferential surface of the intermediate transfer belt 8 onto the sheet P. The cleaner 10 removes residual toners remaining on the outer circumferential surface of the intermediate transfer belt 8 after the color toner image formed on the outer circumferential surface of the intermediate transfer belt 8 is transferred onto the sheet P.

The sheet P having the color toner image is fed by the second transfer roller 19 and the intermediate transfer belt 8 toward the fixing unit 20. In the fixing unit 20, rollers apply heat and pressure to the sheet P having the color toner image while the sheet P is conveyed between the rollers so as to fix the color toner image on the sheet P. The sheet P having the fixed color toner image is fed toward the output roller pair 29. The output roller pair 29 feeds the sheet P having the fixed color toner image onto the output tray 30. The output tray 30 is disposed on top of the image forming apparatus 100. The sheet P fed by the output roller pair 29 is stacked one by one on the output tray 30.

Figure 2:
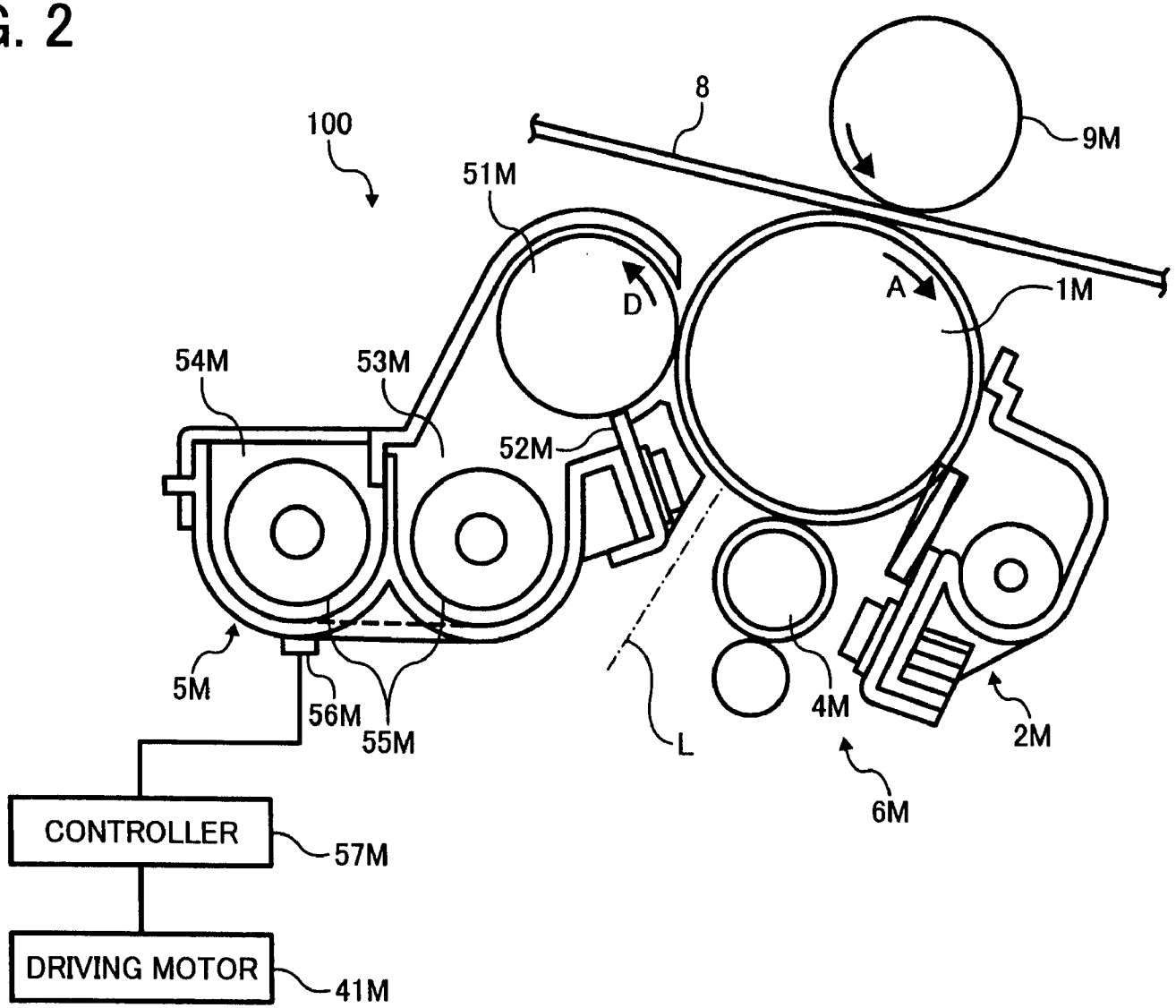
FIG. 2 is a sectional view of a process cartridge of the image forming apparatus shown in FIG. 1.

FIG. 2 illustrates the structure of the process cartridge 6M, which is common to the process cartridges 6Y, 6C, and 6K. As illustrated in FIG. 2, the image forming apparatus 100 further includes a driving motor 41. The development unit 5M of the process cartridge 6M includes a development sleeve 51M, developer containers 53M and 54M, screws 55M, a sensor 56M, a controller 57M, and a doctor blade member 52M.

The development sleeve 51M includes a magnetic field generator and carries a developer. The developer includes a toner and is hereinafter referred to as the toner. The toner includes a two-component developer including magnetic carrier particles and toner particles. The developer containers 53M and 54M are disposed adjacent to each other and contain the toner. The screws 55M agitate the toner. The sensor 56M detects the density of the toner in the developer container 54M. The controller 57M outputs a toner supplying signal when the sensor 56M detects a low density of the toner in the developer container 54M. The driving motor 41 is rotated in accordance with the toner supplying signal. The development sleeve 51M rotates in a rotating direction D to convey the toner to a development area formed between the development sleeve 51M and the photoconductor 1M opposing each other. The doctor blade member 52M regulates the layer thickness of the toner carried by the development sleeve 51M. The developer container 53M is disposed upstream of the doctor blade member 52M in the rotating direction D and contains the toner regulated by the doctor blade member 52M and not conveyed to the development area.

The following describes operations of the development unit 5M. The development unit 5M further includes a developer layer formed on a surface of the development sleeve 51M. The developer layer moves in accordance with the rotation of the development sleeve 51M to pick up the toner from the developer container 53M so as to maintain a predetermined range of density of the toner. Toner particles of the toner picked up are charged by friction with carrier particles. The toner containing the charged toner particles is supplied onto the surface of the development sleeve 51M including a magnetic pole inside and is carried by a magnetic force. The developer layer carried by the development sleeve 51M is conveyed in the rotating direction D in accordance with the rotation of the development sleeve 51M. The doctor 52M regulates the layer thickness of the developer layer. When the developer layer reaches the development area formed between the development sleeve 51M and the photoconductor 1M, the electrostatic latent image formed on the surface of the photoconductor 1M is developed with the toner. The rotating development sleeve 51M conveys the developer layer remaining on the surface of the development sleeve 51 to an upstream portion of the developer container 53M in the rotating direction D.

Figure 3:
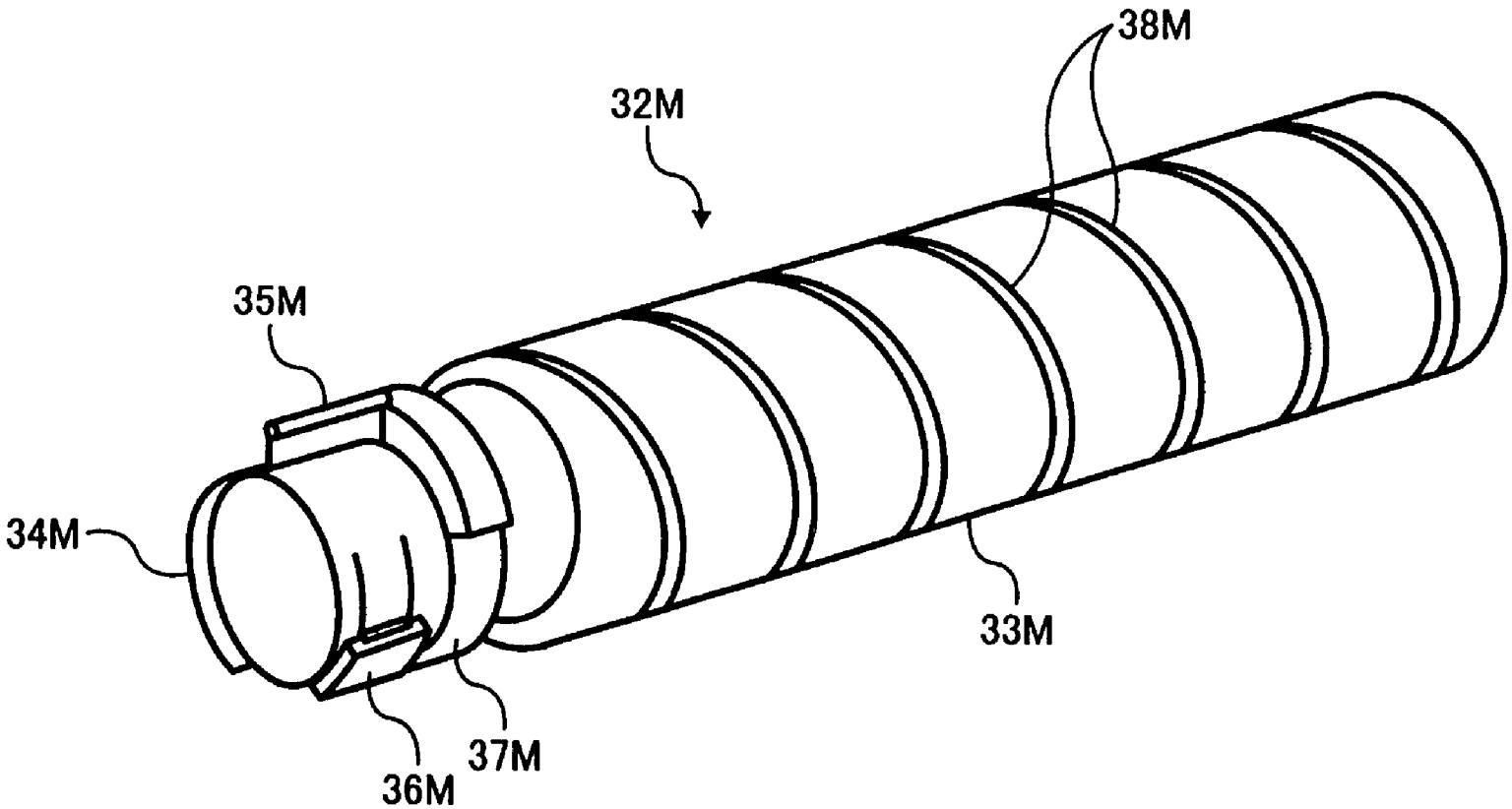
FIG. 3 is a perspective view of a toner bottle of the image forming apparatus shown in FIG. 1.

As illustrated in FIG. 3, the toner bottle 32M includes a bottle 33M, a resin case 34M, a handle 35M, a bottle rotating gear 37M, a shutter 36M, and a groove 38M. The bottle 33M contains the toner. The resin case 34M is disposed at one end of the bottle 33M in a longitudinal direction of the bottle 33M. The handle 35M is integrally molded with the resin case 34M. The bottle rotating gear 37M is disposed at the one end of the bottle 33M where the resin case 34M is disposed and rotates together with the bottle 33M. The shutter 36M opens and closes a toner outlet (not shown) from which the toner in the bottle 33M is supplied. The groove 38M is formed on an inner circumferential surface of the bottle 33M in a spiral-like shape. When the bottle 33M rotates, the groove 38M guides and conveys the toner in the bottle 33M toward the resin case 34M.

To set the toner bottle 32M into the image forming apparatus 100, a user lifts the output tray 30 to expose the toner bottle base 31. When the user places the toner bottle 32M on the toner bottle base 31, the user turns the handle 35M. The resin case 34M integrally molded with the handle 35M turns to move the shutter 36M in a circumferential direction of the resin case 34M. Thus, the shutter 36M opens the toner outlet and the resin case 34M and the toner bottle base 31 are connected to each other.

To remove the toner bottle 32M from the image forming apparatus 100, the user turns the handle 35M in an opposite direction to release the connection between the resin case 34M and the toner bottle base 31M. The shutter 36M closes the toner outlet. The user may catch the handle 35M and may pick up the toner bottle 32M from the image forming apparatus 100. The user may set and remove the toner bottle 32M from a top of the image forming apparatus 100. Therefore, the user may easily understand how to set and remove the toner bottle 32M and thereby may easily replace the toner bottle 32M. Since the handle 35M is integrally molded with the resin case 34M, the user may easily set the toner bottle 32M onto the toner bottle base 31M by turning the handle 35M.

When the toner bottle 32M is not set in the image forming apparatus 100, the shutter 36M does not open even when the user turns the handle 35M integrally molded with the resin case 34M. Thus, the toner may not spill out of the bottle 33M while the user replaces the toner bottle 32M.

Figure 4:
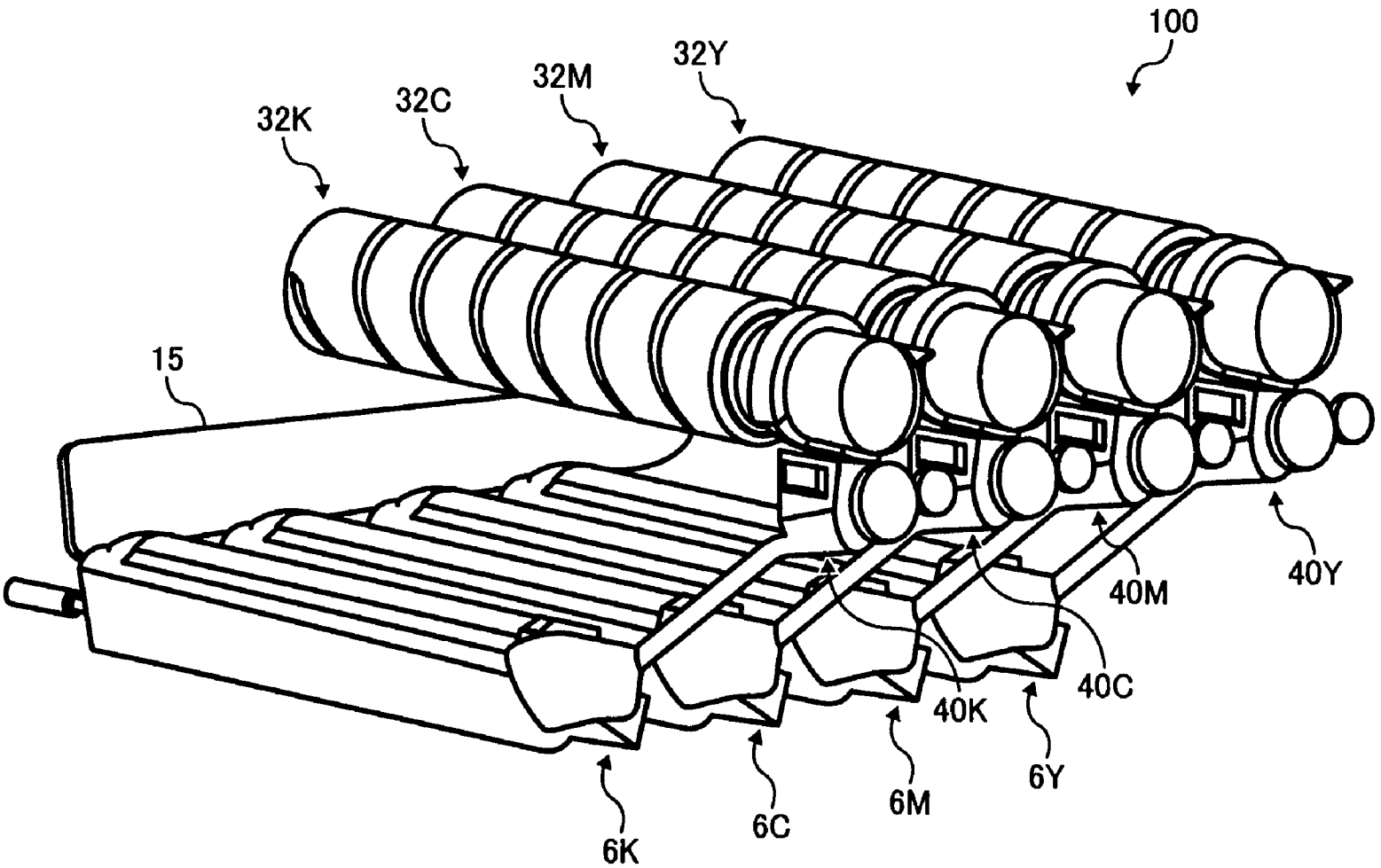
FIG. 4 is a perspective view of a toner supplier of the image forming apparatus shown in FIG. 1 connected with the process cartridge shown in FIG. 2 and the toner bottle shown in FIG. 3.

As illustrated in FIG. 4, the image forming apparatus 100 further includes toner suppliers 40Y, 40M, 40C, and 40K. The toner suppliers 40Y, 40M, 40C, and 40K are disposed near a back side of the image forming apparatus 100 and respectively supply the yellow, magenta, cyan, and black toners from the toner bottles 32Y, 32M, 32C, and 32K to the process cartridges 6Y, 6M, 6C, and 6K. The toner suppliers 40Y, 40M, 40C, and 40K are separately provided from the toner bottles 32Y, 32M, 32C, and 32K and the process cartridges 6Y, 6M, 6C, and 6K. Therefore, the toner bottles 32Y, 32M, 32C, and 32K and the process cartridges 6Y, 6M, 6C, and 6K may have a compact size. In the image forming apparatus 100, the toner bottles 32Y, 32M, 32C, and 32K are not disposed close to the process cartridges 6Y, 6M, 6C, and 6K. Therefore, the image forming apparatus 100 may provide flexibility and variations in design and thereby may have a compact size.

The toner outlets of the toner bottles 32Y, 32M, 32C, and 32K, the toner suppliers 40Y, 40M, 40C, and 40K, and toner inlets (not shown) of the developer containers 54Y, 54M, 54C, and 54K of the process cartridges 6Y, 6M, 6C, and 6K are disposed near one end of the intermediate transfer unit 15 in a direction perpendicular to the rotating direction B of the intermediate transfer belt 8. Therefore, toner conveying routes of the toner suppliers 40Y, 40M, 40C, and 40K which respectively connect the toner outlets of the toner bottles 32Y, 32M, 32C, and 32K with the toner inlets of the developer containers 54Y, 54M, 54C, and 54K may become short, providing the compact image forming apparatus 100 and reducing or preventing the toner from clogging the toner conveying routes of the toner suppliers 40Y, 40M, 40C, and 40K.

Figure 5:
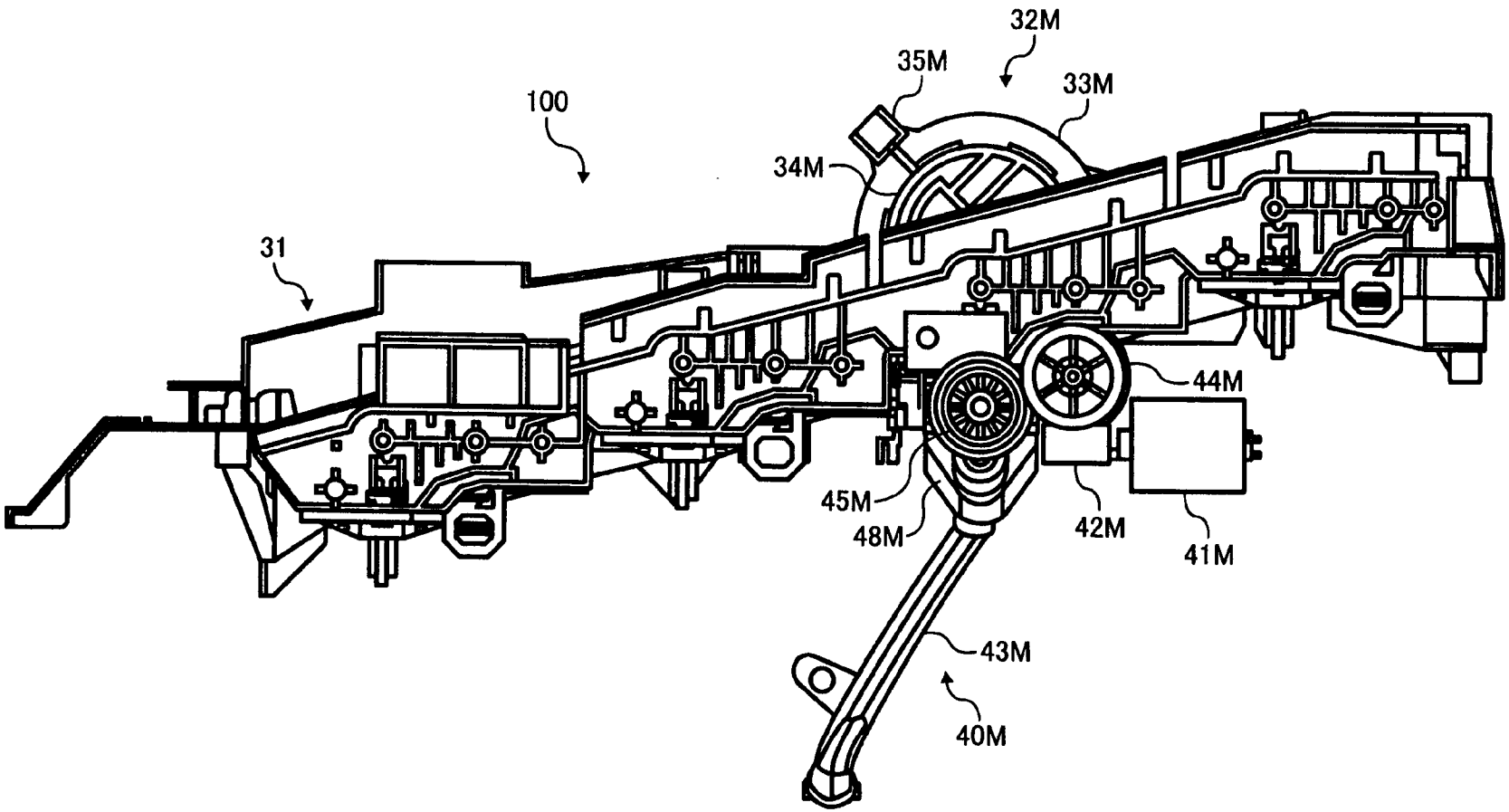
FIG. 5 is a sectional front view of a toner bottle base of the image forming apparatus shown in FIG. 1, the toner bottle shown in FIG. 3, and the toner supplier shown in FIG. 4.
Figure 6:
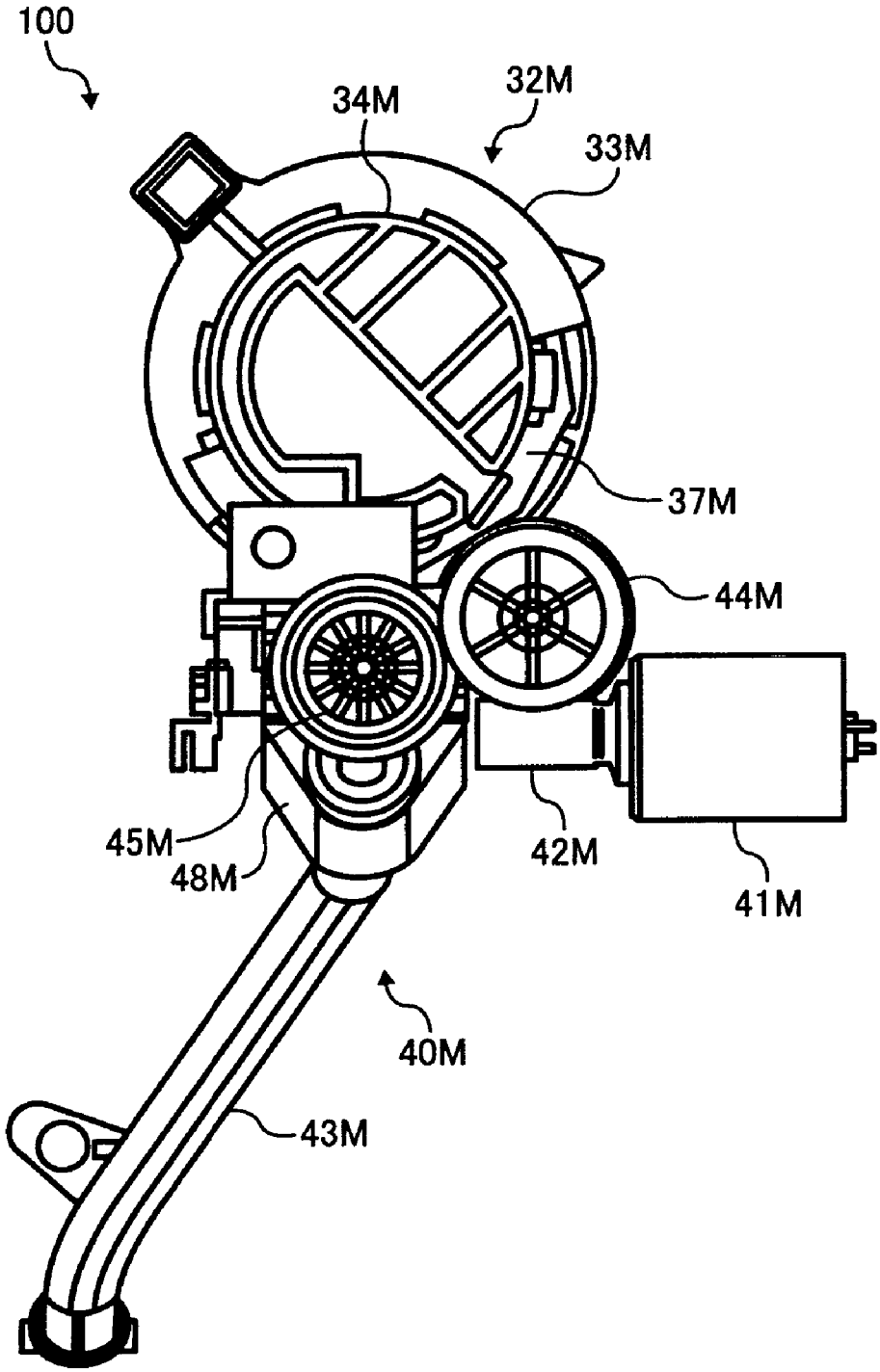
FIG. 6 is a sectional front view of the toner bottle and the toner supplier shown in FIG. 5.
Figure 7:
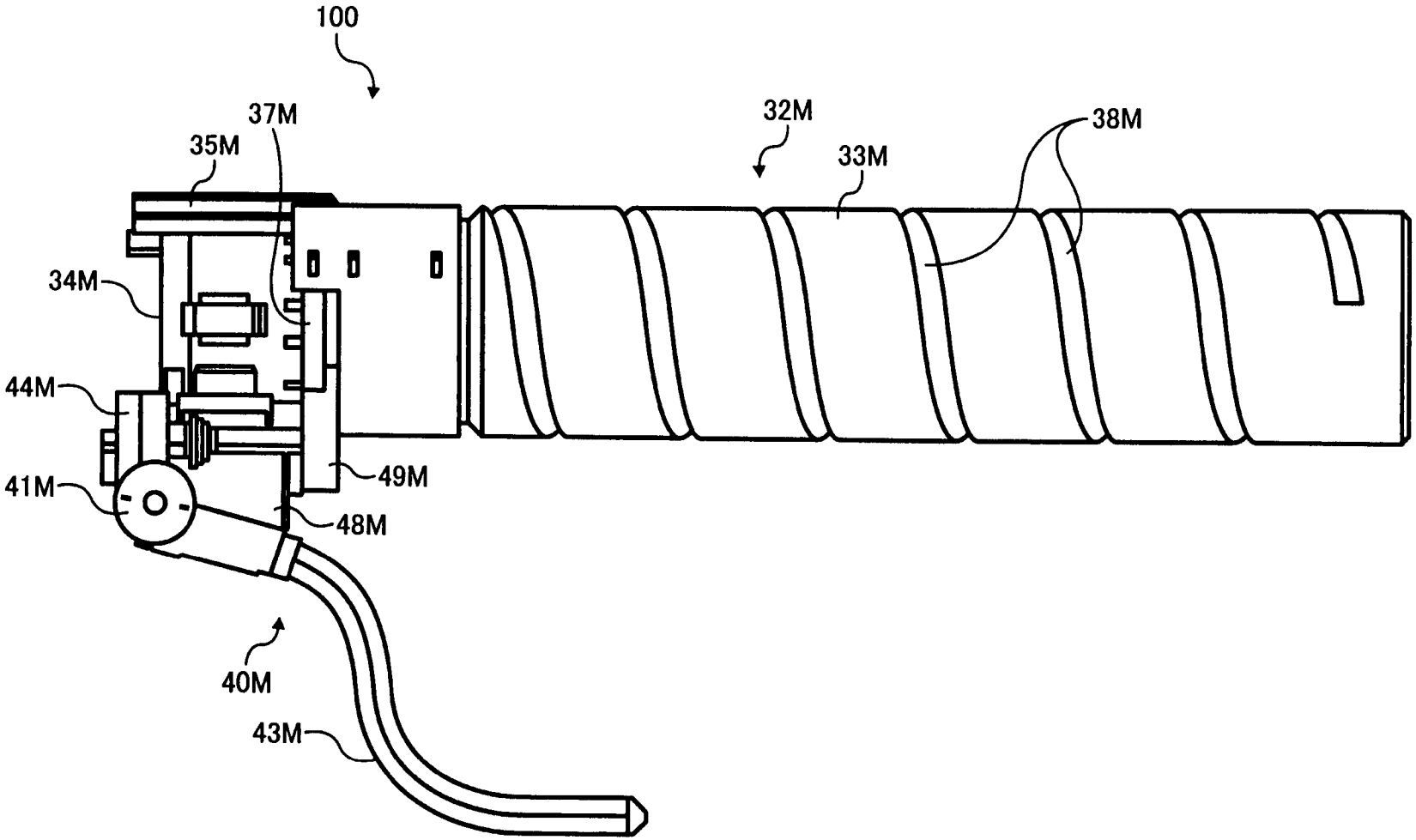
FIG. 7 is a sectional side view of the toner bottle and the toner supplier shown in FIG. 6.
Figure 8:
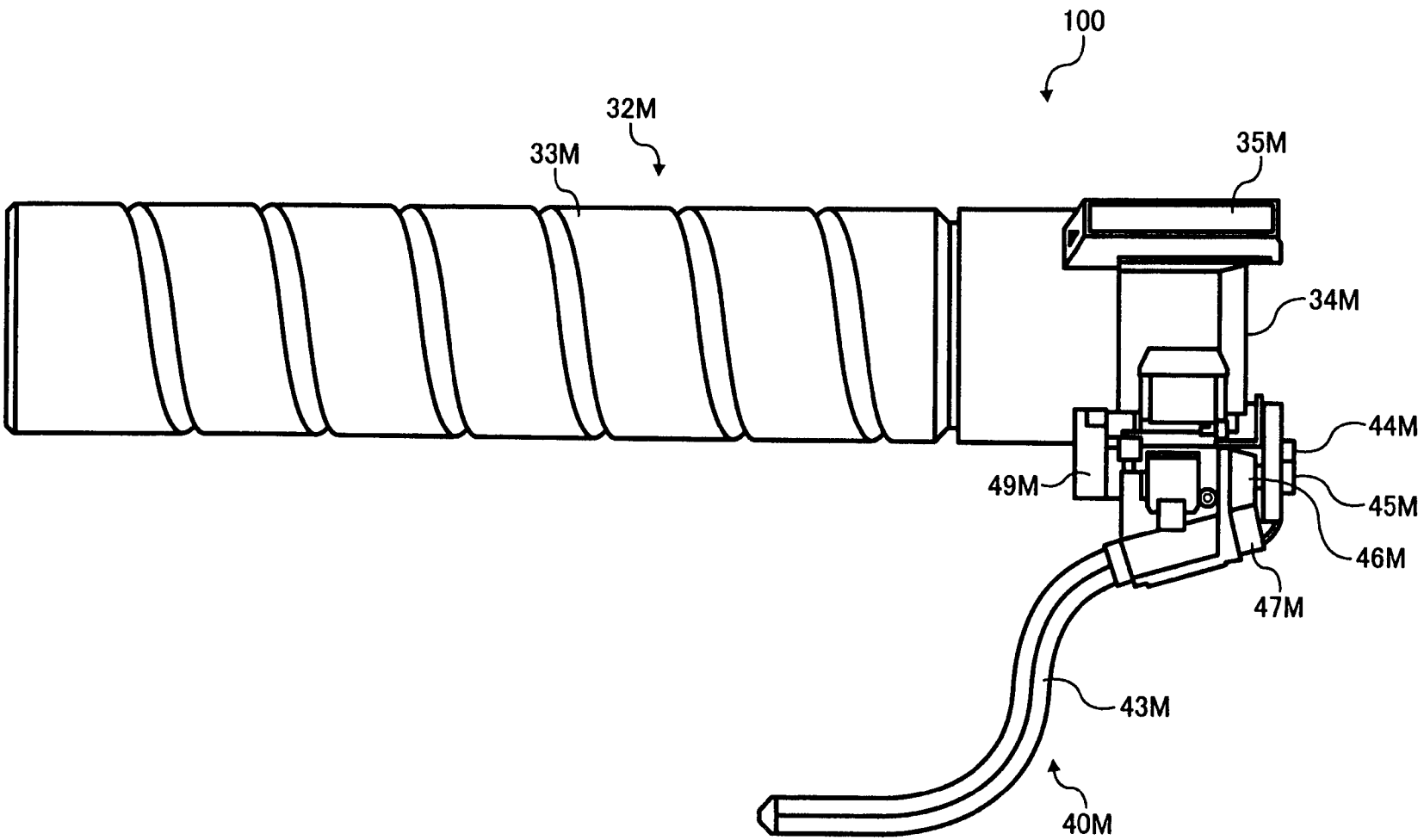
FIG. 8 is another sectional side view of the toner bottle and the toner supplier shown in FIG. 6.

FIG. 5 is a sectional front view illustrating a disposition of the toner bottle base 31, the toner bottle 32M, and the toner supplier 40M, which is common to a disposition of the toner bottle base 31, the toner bottle 32Y, 32C, or 32K, and the toner supplier 40Y, 40C, or 40K. FIG. 6 is a sectional front view illustrating a disposition of the toner bottle 32M and the toner supplier 40M, in which the toner bottle base 31 is omitted. FIG. 7 is a sectional side view of the toner bottle 32M and the toner supplier 40M of FIG. 6. FIG. 8 is another sectional side view of the toner bottle 32M and the toner supplier 40M of FIG. 6.

As illustrated in FIGS. 5 and 6, the toner supplier 40M includes the driving motor 41M, a worm gear 42M, a transmission gear 44M, a gear 45M, a sub hopper 48M, and a pipe 43M. As illustrated in FIGS. 7 and 8, the toner supplier 40M further includes a bottle driving gear 49M.

The driving motor 41M drives the worm gear 42M. The worm gear 42M coaxially rotates with the driving motor 41M to transmit a driving force from the driving motor 41M to the transmission gear 44M. The transmission gear 44M is engaged with the gear 45M and rotates the gear 45M. The bottle driving gear 49M is coaxial with the transmission gear 44M and is engaged with the bottle rotating gear 37M. Thus, when the driving motor 41M is rotated, the bottle 33M rotates together with the bottle rotating gear 37M. The rotating bottle 33M causes the toner in the bottle 33M to be guided and conveyed by the groove 38M to the toner outlet of the resin case 34M. The sub hopper 48M receives the toner fallen from the toner outlet of the resin case 34M. The pipe 43M is connected to a lower portion of the sub hopper 48M as illustrated in FIGS. 5 to 7. The toner conveyed to the lower portion of the sub hopper 48M is further conveyed through the pipe 43M to the toner inlet of the developer container 54M of the development unit 5M. Thus, the density of the toner in the development unit 5M is adjusted.

As illustrated in FIG. 8, the toner supplier 40M further includes an agitator bevel gear 46M and a conveyer bevel gear 47M. The agitator bevel gear 46M is engaged with the conveyer bevel gear 47M.

Figure 9:
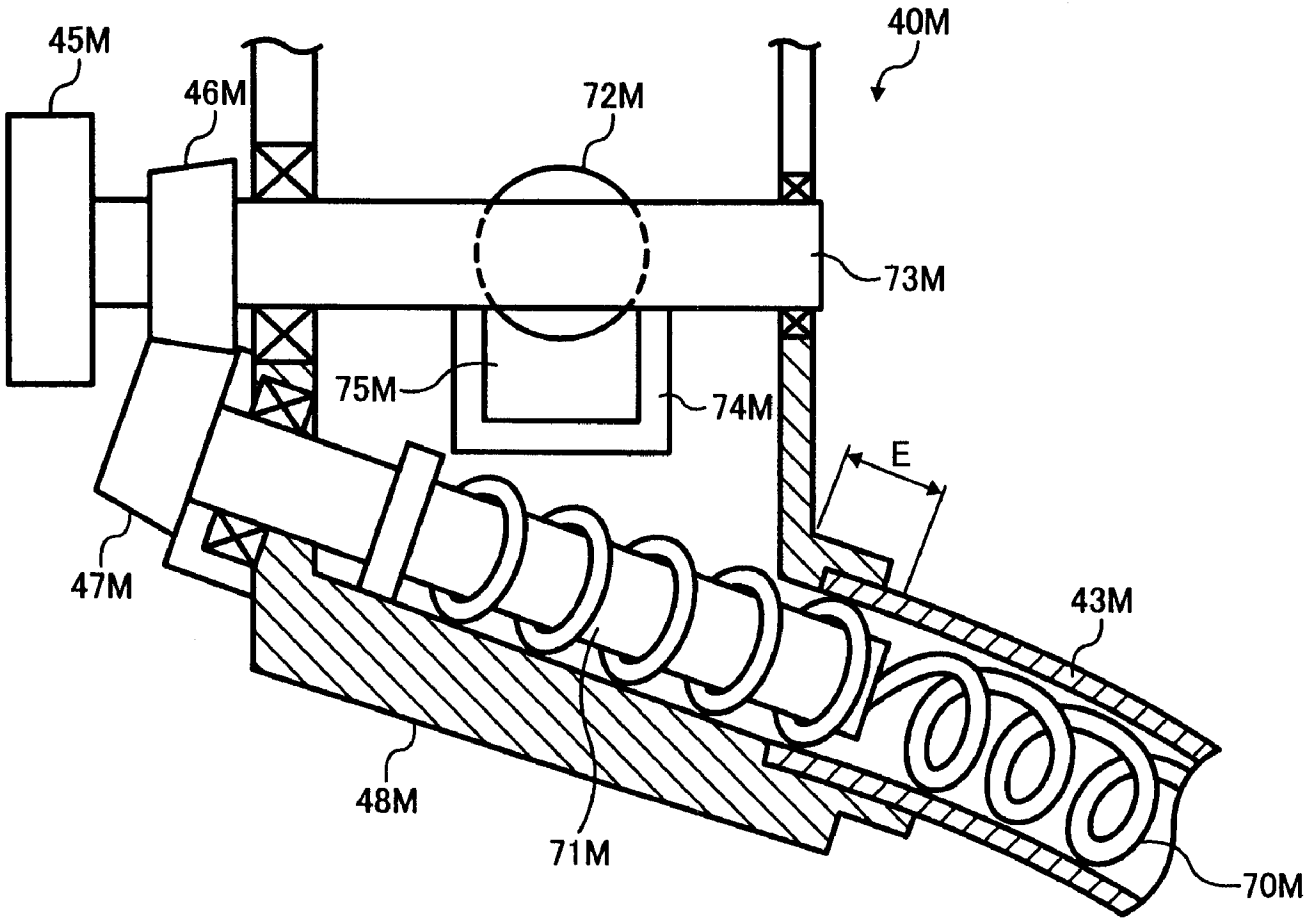
FIG. 9 is a sectional side view of the toner supplier shown in FIG. 8.
Figure 10:
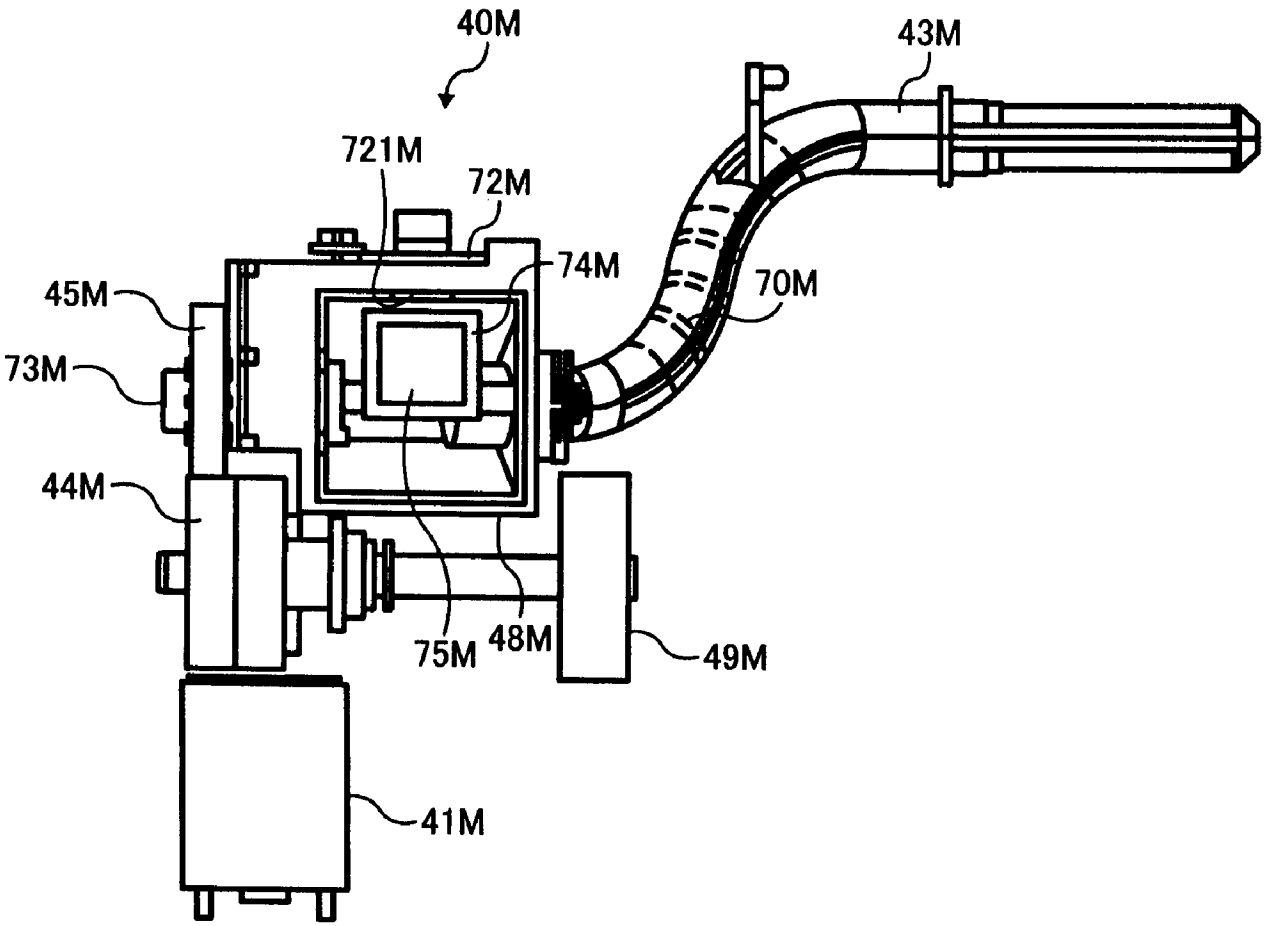
FIG. 10 is a sectional top view of the toner supplier shown in FIG. 9.
Figure 11:
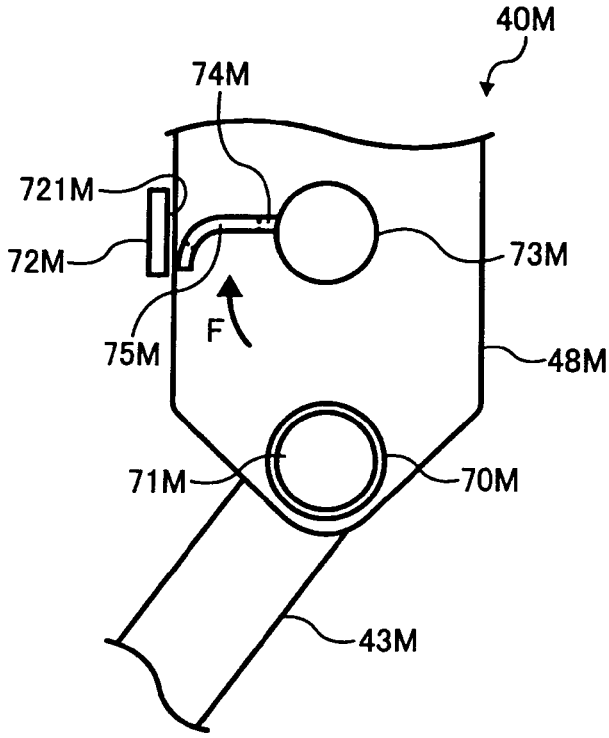
FIG. 11 is a sectional front view of the toner supplier shown in FIG. 9.

FIG. 9 is a sectional side view of the toner supplier 40M. FIG. 10 is a sectional top view of the toner supplier 40M. FIG. 11 is a sectional front view of the toner supplier 40M. As illustrated in FIG. 9, the toner supplier 40M further includes a conveying coil 70M, a rotating shaft 71M, a rotating shaft 73M, an agitator 74M, an opening 75M, and a sensor 72M.

The conveying coil 70M is disposed in the pipe 43M with a gap in a range of from about 0.1 mm to about 0.2 mm provided between an inner circumferential surface of the pipe 43M and an outer circumferential surface of the conveying coil 70M. The conveying coil 70M applies a force to the toner, which moves the toner in a toner conveyance direction, so as to prevent the toner from being accumulated in the pipe 43M. Thus, the toner, even when accumulated in the pipe 43M, may not flow all together into the development unit 5M due to some impact.

The conveying coil 70M may be coiled even if the pipe 43M is bended. Therefore, the pipe 43M needs not be formed in a straight shape, providing an increased flexibility in the layout of elements in the development unit 5M. As a result, the development unit 5M may be compact in size.

The conveying coil 70M has an outside diameter of about 7 mm, an inside diameter of about 5 mm, and a coil pitch of about 8 mm. According to a measurement, one rotation of the conveying coil 70M conveyed the toner of about 83.4 mg.

If the conveying coil 70M includes a metal, friction between the outer circumferential surface of the conveying coil 70M and the inner circumferential surface of the pipe 43M, if any, may generate an agglomerated core of the toner, and thereby may produce a faulty image containing a white spot. In the toner supplier 40M, the conveying coil 70M includes a resin. Therefore, friction between the outer circumferential surface of the conveying coil 70M and the inner circumferential surface of the pipe 43M is weak and may not generate the agglomerated core of the toner, preventing the faulty image containing the white spot from being produced.

The driving motor 41M which is a driving source of the conveying coil 70M rotates in accordance with the detected density of the toner in the developer container 54M. The detected density is updated every about 240 millisecond. A toner supplying operation starts when about 240 millisecond elapses after development starts at the latest.

In the sub hopper 48M, the rotating shaft 71M is attached to a portion of the conveying coil 70M facing the rotating shaft 71M. An area E is formed from a downstream end of the sub hopper 48M in the toner conveyance direction to a downstream head of the rotating shaft 71M. In the area E, the conveying coil 70M is coiled for at least one pitch and a portion of the conveying coil 70M facing the pipe 43M contacts the inner circumferential surface of the pipe 43M. The rotating shaft 71M is disposed close to the portion of the conveying coil 70M facing the rotating shaft 71M. Therefore, there is almost no gap provided between the rotating shaft 71M and the portion of the conveying coil 70M facing the rotating shaft 71M and between the inner circumferential surface of the pipe 43M and the portion of the conveying coil 70M facing the pipe 43M. Thus, the weight of the toner may not cause the toner to pass the area E. Whenever the toner is output from the toner bottle 32M, the toner is held in the area E so that only the rotation of the conveying coil 70M may cause the toner to pass the area E. Thus, a steady amount of the toner may pass the area E. As a result, the steady amount of the toner may be supplied to the development unit 5M disposed downstream of the area E in the toner conveyance direction.

The rotating shaft 73M is connected to the gear 45M and is rotated by the driving force transmitted from the driving motor 41M via the worm gear 42M, the transmission gear 44M, and the gear 45M.

The agitator 74M is disposed in the sub hopper 48M and rotates to agitate the toner in the sub hopper 48M. The agitator 74M is formed as a paddle having a plate-like shape. The agitator 74M is fixed to the rotating shaft 73M and is rotated by the rotating gear 45M. The agitator bevel gear 46M is disposed on the rotating shaft 73M and is engaged with the conveyer bevel gear 47M disposed on the rotating shaft 71M. Thus, the rotating shaft 73M rotates the rotating shaft 71M via the agitator bevel gear 46M and the conveyer bevel gear 47M. The agitator bevel gear 46M and the conveyer bevel gear 47M are formed with a common shape and have a common number of gear teeth. Thus, the agitator 74M and the conveying coil 70M rotate with a common number of revolutions per minute.

As described above, the agitator 74M and the conveying coil 70M may be rotated by the common driving source, that is, the driving motor 41M. Thus, a number of elements used for driving the agitator 74M and the conveying coil 70M may be reduced, resulting in decreased production costs. The agitator bevel gear 46M and the conveyer bevel gear 47M have the common number of gear teeth. Thus, one of the agitator bevel gear 46M and the conveyer bevel gear 47M needs not be larger than the other, saving space in the toner supplier 40M. The agitator bevel gear 46M and the conveyer bevel gear 47M are formed in the common shape, resulting in decreased production costs.

The opening 75M is provided on the agitator 74M. While the agitator 74M rotates, the toner slips through the opening 75M. Thus, the toner may not be excessively agitated by the agitator 74M. The toner may not be excessively dispersed in the air in the sub hopper 48M and the amount of the toner per unit volume may not be partially decreased. The sensor 72M is disposed on an interior side wall of the sub hopper 48M and detects the toner. As illustrated in FIG. 10, the sensor 72M includes a detecting surface 721M which is provided at a predetermined height in the sub hopper 48M. When the toner is not supplied from the toner bottle 32M and the sensor 72M does not detect the toner at the detecting surface 721M, the sensor 72M may detect an "almost empty" state that the toner bottle 32M is empty but the sub hopper 48M contains the toner. The sensor 72M includes a piezoelectric vibration toner level sensor available from TDK Corporation.

The agitator 74M includes a flexible material such as a PET (polyethylene terephthalate). The length from the rotating shaft 73M to a foremost end of the agitator 74M is by about 1 mm to about 3 mm longer than a distance from the rotating shaft 73M to the detecting surface 721M. The width of the agitator 74M is greater than a width of the detecting surface 721M. A length of the agitator 74M varies depending on the size of the sub hopper 48M and may be in a range of from about 8 mm to about 19 mm. The image forming apparatus 100 generally includes the agitator 74M having the length of about 13 mm.

The length from the rotating shaft 73M to the foremost end of the agitator 74M is by about 1 mm to about 3 mm longer than the distance from the rotating shaft 73M to the detecting surface 721M. Thus, the foremost end of the agitator 74M scrapes the detecting surface 721M in a state that the foremost end of the agitator 74M is engaged in the detecting surface 721M by about 1 mm to about 3 mm. The foremost end of the agitator 74M scrapes the detecting surface 721M to prevent the toner from adhering to the detecting surface 721M. Thus, the sensor 72M may not erroneously detect the toner adhered to the detecting surface 721M. Namely, the agitator 74M may clean the detecting surface 721M.

As illustrated in FIG. 11, the agitator 74M rotates in a rotating direction F. The foremost end of the agitator 74M scrapes the detecting surface 721M upward. The flexible material, such as the PET, of the agitator 74M may suppress abrasion and wear of the detecting surface 721M more effectively than an inflexible material such as a metal.

The toner supplied from the toner bottle 32M enters the sub hopper 48M from an upper portion of the sub hopper 48M and is conveyed toward the development unit 5M by the conveying coil 70M disposed in the lower portion of the sub hopper 48M. The toner moves from the upper portion to the lower portion of the sub hopper 48M. The rotating shaft 73M extends in a horizontal direction. Namely, the rotating shaft 73M extends in a direction perpendicular to the direction in which the toner moves in the sub hopper 48M.

Figure 12:
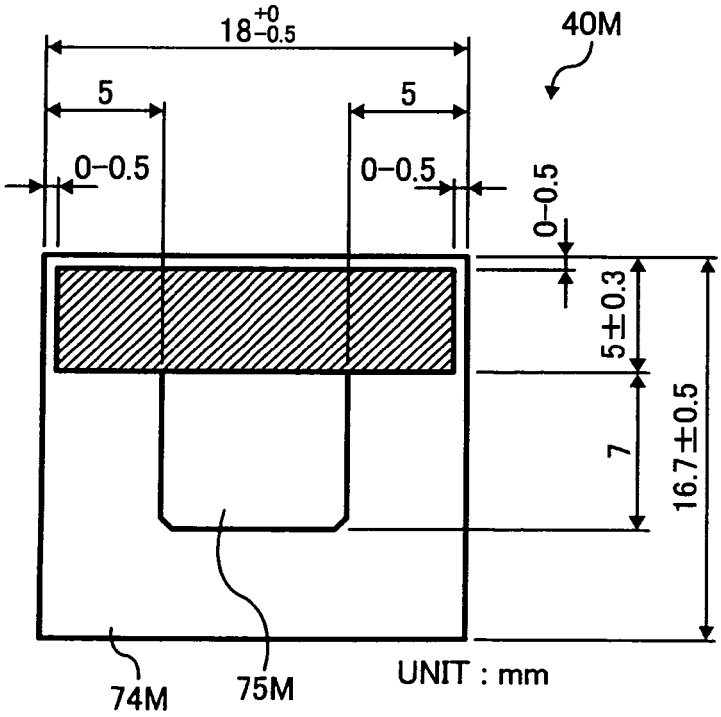
FIG. 12 illustrates an opening and an agitator of the toner supplier shown in FIG. 11.

FIG. 12 illustrates the opening 75M provided on the agitator 74M. The opening 75M is formed in a tetragon-like shape and has dimensions shown in FIG. 12, for example.

Figure 13:
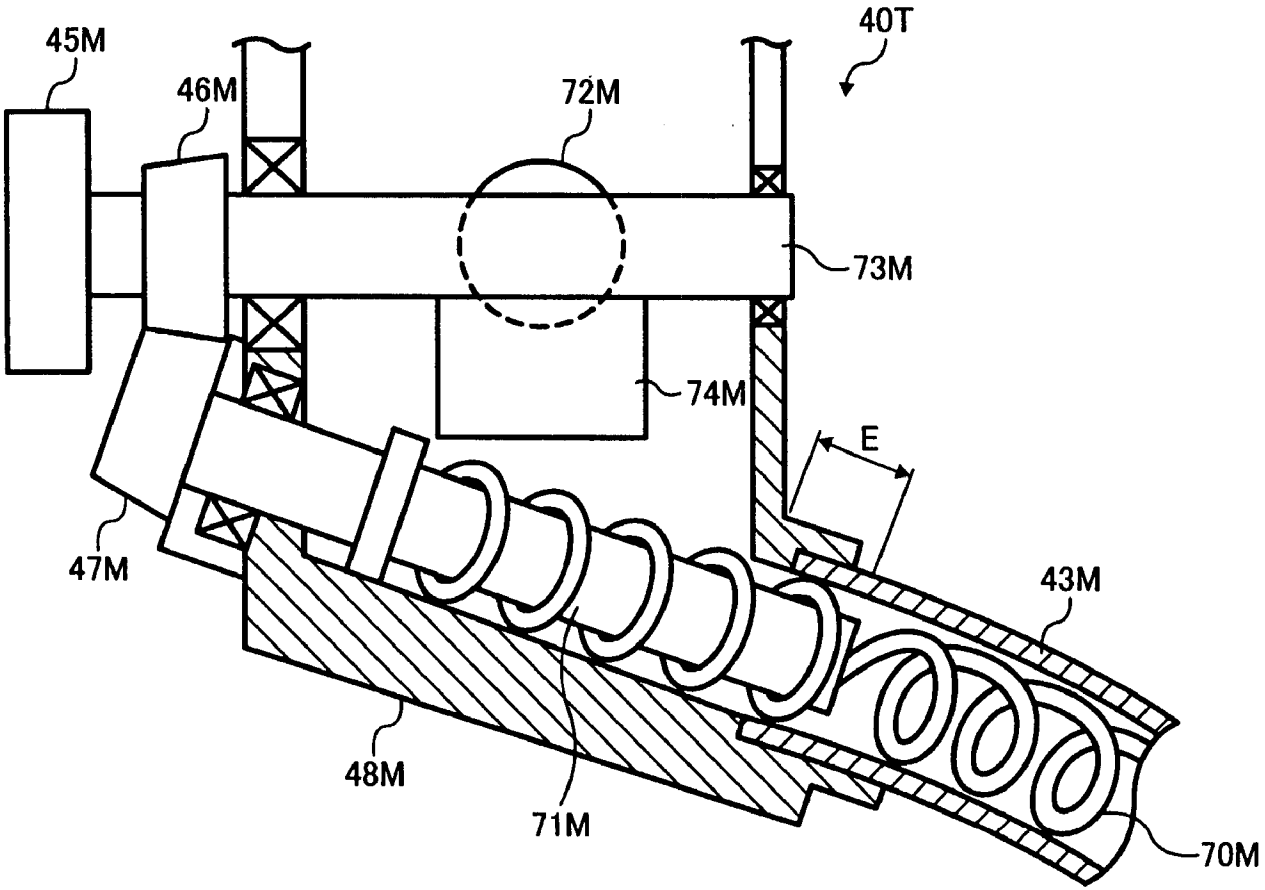
FIG. 13 is a sectional side view of a tester toner supplier.
Figure 14:
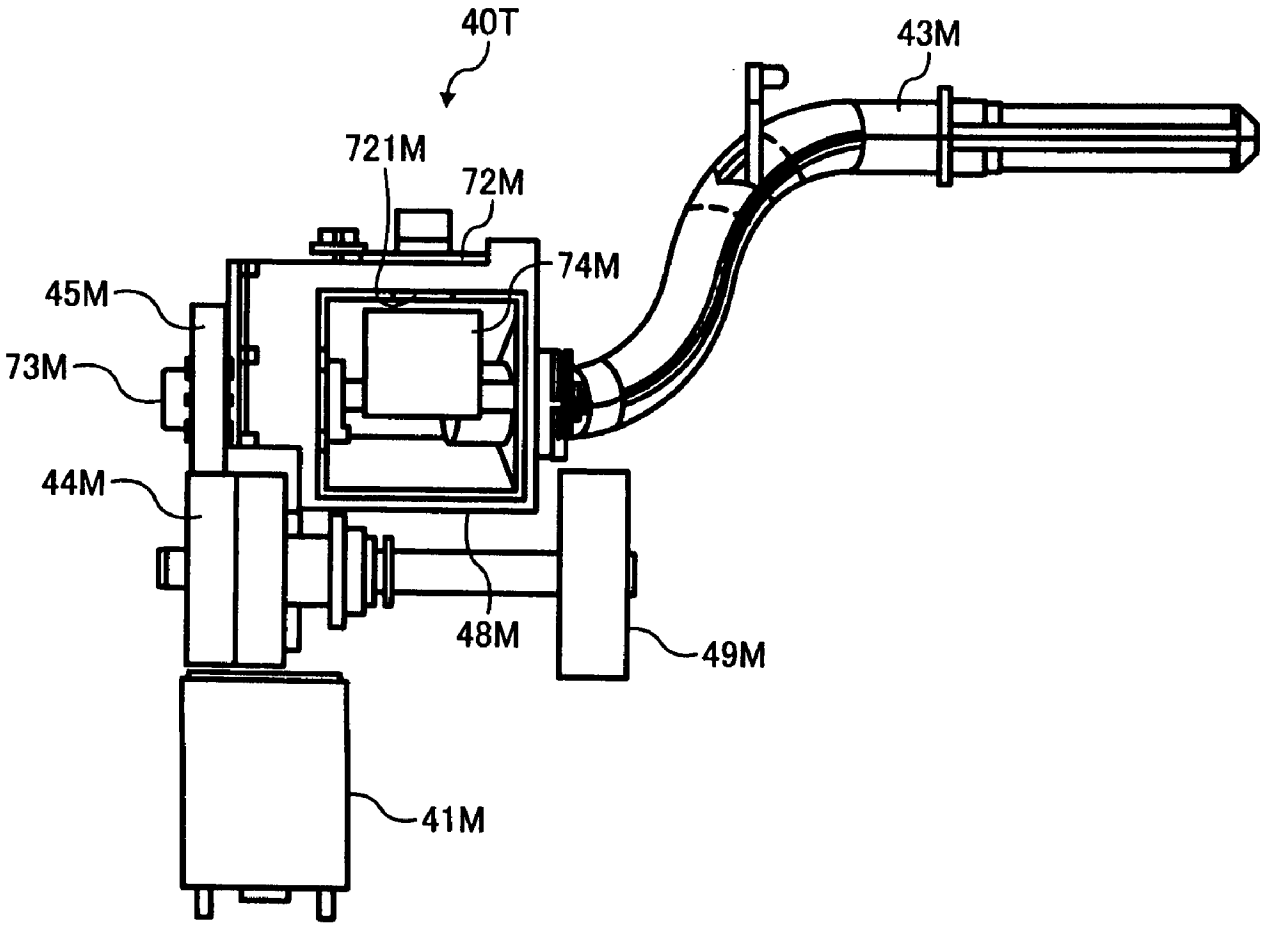
FIG. 14 is a sectional top view of the tester toner supplier shown in FIG. 13.
Figure 15:
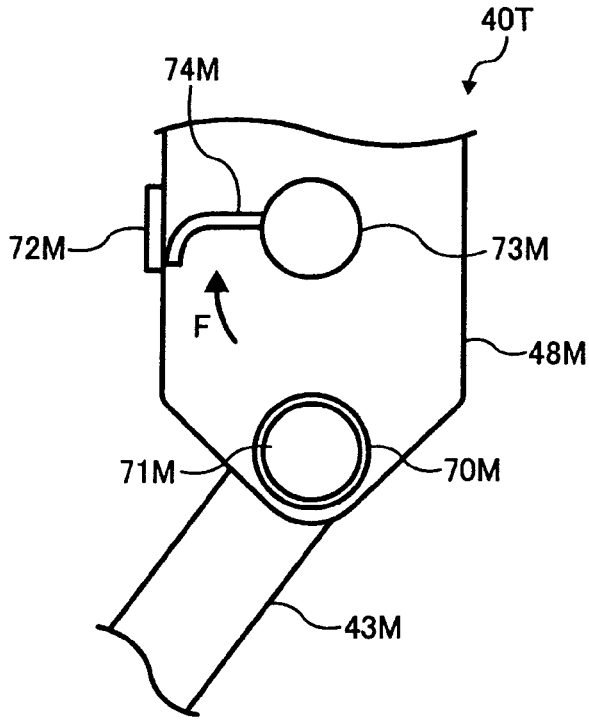
FIG. 15 is a sectional front view of the tester toner supplier shown in FIG. 13.

FIGS. 13 to 15 illustrate a tester toner supplier 40T. FIG. 13 is a sectional side view of the tester toner supplier 40T. FIG. 14 is a sectional top view of the tester toner supplier 40T. FIG. 15 is a sectional front view of the tester toner supplier 40T. As illustrated in FIGS. 13 to 15, the tester toner supplier 40T does not include the opening 75M. The other elements of the tester toner supplier 40T are common to the toner supplier 40M as illustrated in FIGS. 9 to 11.

In the image forming apparatus 100, the toner having an increased flowability is used so that the toner may be conveyed at an increased speed. Specifically, the toner has an accelerated agglomeration (i.e., an index showing the flowability of the toner) of about 15 percent or lower.

The accelerated agglomeration of the toner was measured as described below. A powder tester available from Hosokawa Micron Corporation was used as a measurement device.

A thermostatic vessel containing a sample toner was kept for about 24±1 hours at a temperature of about 35±2 degrees centigrade. Three sieves having a mesh of different sizes (e.g., about 75 μm, about 44 μm, and about 22 μm) were layered in a state that the sieve having a larger size mesh was layered on the sieve having a smaller size mesh. The sample toner was put into the top sieve having the largest size mesh and was screened at a predetermined vibration. The sample toner left on each sieve after screening was weighed as powder weight. The agglomeration of the sample toner left on each sieve was calculated according to the following equations. In the equations below, X1, X2, and X3 respectively represent the agglomerations of the sample toner left on the top, middle, and bottom sieves after screening. W1, W2, and W3 respectively represent the powder weights of the sample toner left on the top, middle, and bottom sieves after screening. S represents the weight of the sample toner put into the top sieve before screening.

$$X1=(W1/S)\times 100$$

$$X2=(W2/S)\times 100\times 3/5$$

$$X3=(W3/S)\times 100\times 1/5$$

The accelerated agglomeration was calculated according to the following equation in which Y represents the accelerated agglomeration.

$$Y=X1+X2+X3$$

The following describes an experiment for examining amounts of the toner conveyed by one rotation of the agitator 74M. A plurality of toners having different flowabilities were conveyed by a test machine. The plurality of toners were conveyed for a predetermined time period and the amount of the toner conveyed by one rotation of the agitator 74M was calculated based on the number of revolutions of the agitator 74M and the amount of each of the toners conveyed. The result of the experiment is shown in Table 1 below and FIG. 16.

TABLE 1

| Accelerated agglomeration (%) | Amount of toner conveyed by one rotation of the agitator 74M (g) |
|---|---|
| 7.87 | $(8.89)^{-2}$ |
| 10.80 | $(8.45)^{-2}$ |
| 12.84 | $(8.29)^{-2}$ |
| 15.80 | $(7.00)^{-2}$ |
| 17.90 | $(4.24)^{-2}$ |
| 19.00 | $(2.82)^{-2}$ |

Figure 16:
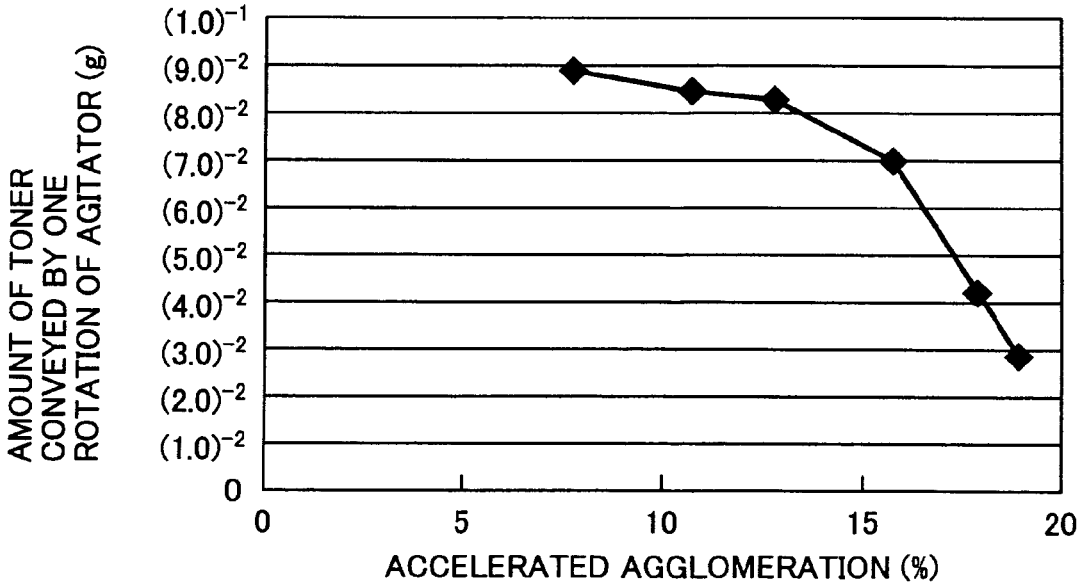
FIG. 16 is a graph illustrating a relationship between an accelerated agglomeration and an amount of toner conveyed by one rotation of an agitator of the tester toner supplier shown in FIG. 15.

FIG. 16 is a graph illustrating the relationship between the accelerated agglomeration and the amount of toner conveyed by one rotation of the agitator 74M shown in table 1. Table 1 and FIG. 16 show that the amount of toner conveyed by one rotation of the agitator 74M substantially decreased when the accelerated agglomeration was higher than 15 percent. The toner having the accelerated agglomeration of not lower than about 8 percent and not higher than about 15 percent may be preferably used. The toner having the accelerated agglomeration of lower than about 8 percent may be too flowable.

The toner supplier 40M is requested to convey an increased amount of the toner (e.g., 12.0±(20 percent)g/min) so that the image forming apparatus 100 may form an image at a high speed. One rotation of the conveying coil 70M conveyed the toner of an amount of about 83.4 mg. To convey the increased amount of the toner as described above, the conveying coil 70M needs to rotate at about 144 (±20 percent) rpm. In the toner supplier 40M, the number of revolutions per minute of the conveying coil 70M and the agitator 74M is common. Therefore, when the conveying coil 70M is configured to rotate at about 144 (±20 percent) rpm, the agitator 74M also rotates at about 144 (±20 percent) rpm.

When the conveying coil 70M was configured to rotate at about 124 rpm or more, the sensor 72M detected that the sub hopper 48M was almost empty even when an accumulated toner level reached the detecting surface 741M.

In the tester toner supplier 40T, a toner having a high flowability (e.g., the accelerated agglomeration of about 15 percent or lower) was used so that an image may be formed on a recording medium at a high speed. When the number of revolutions per minute of the agitator 74M was increased and the toner was excessively agitated, the toner was excessively dispersed in the air and was stirred up in the sub hopper 48M. The amount of the toner per unit volume was partially decreased, causing the sensor 72M to improperly detect the toner. When the agitator 74M scraped the detecting surface 721M, the toner was stirred up near the detecting surface 721M and the amount of the toner per unit volume partially decreased.

The toner level sensor available from TDK Corporation was used as the sensor 72M. The toner level sensor detected the toner in accordance with a load applied to the detecting surface 721M by the toner. When the toner was stirred up, the load applied to the detecting surface 721M decreased. Thus, the sensor 72M erroneously detected that the sub hopper 48M was almost empty even when the accumulated toner level reached the detecting surface 741M.

The sensor 72M detects whether the accumulated toner level reaches the detecting surface 741M or not about every 200 millisecond. The sensor 72M sends a detection signal to the controller 57M about every 200 millisecond. The sensor 72M performs detection five times as one set. When the controller 57M receives three or more detection signals indicating that the accumulated toner level reaches the detecting surface 741M after the sensor 72M performs the one set of detections, the controller 57M judges that the accumulated toner level reaches the detecting surface 741M. When the controller 57M receives two or less detection signals indicating that the accumulated toner level reaches the detecting surface 741M after the sensor 72M performs the one set of detections, the controller 57M judges that the accumulated toner level does not reach the detecting surface 741M.

The driving force from the driving motor 41M is transmitted via the bottle rotating gear 37M for rotating the toner bottle 32M. When the number of revolutions per minute of the driving motor 41M is increased to increase the number of revolutions per minute of the conveying coil 70M, the number of revolutions per minute of the toner bottle 32M is also increased. The following equation shows the ratio of the number of revolutions per minute of the toner bottle 32M to the number of revolutions per minute of the conveying coil 70M. In the equation below, R1 represents the number of revolutions per minute of the toner bottle 32M and R2 represents the number of revolutions per minute of the conveying coil 70M.

$$R1:R2=1:2.067$$

When the conveying coil 70M rotates at 124 rpm, the toner bottle 32M rotates at 60 rpm.

The image forming apparatus 100 stops the image forming operation when the sub hopper 48M is almost empty. The image forming apparatus 100 resumes the image forming operation when the toner bottle 32M is replaced with a new one or when the toner bottle 32M is removed from the toner bottle base 31 and then is set again on the toner bottle base 31 after the amount of the toner remaining in the toner bottle 32M is checked. Thus, when the sensor 72M erroneously detects that the sub hopper 48M is almost empty, an extra work is needed to resume the image forming operation, resulting in a decreased work efficiency.

To suppress excessive agitation of the toner in the sub hopper 48M while increasing the number of revolutions per minute of the conveying coil 70M, the agitator 74M may be configured to rotate more slowly than the conveying coil 70M. To vary the number of revolutions per minute of the agitator 74M from the number of revolutions per minute of the conveying coil 70M, the agitator bevel gear 46M and the conveyer bevel gear 47M may not be formed in the common shape, resulting in increased production costs. When the conveyer bevel gear 47M for transmitting the driving force to the rotating shaft 71M is formed larger than the agitator bevel gear 46M to increase the number of revolutions per minute of the conveying coil 70M, a distance between the rotating shafts 71M and 73M may become longer, resulting in a larger size toner supplier 40M. Therefore, a mechanism for preventing the flowability of the toner in the sub hopper 48M from increasing is requested without varying the number of revolutions per minute of the agitator 74M from the number of revolutions per minute of the conveying coil 70M.

Figure 17A:
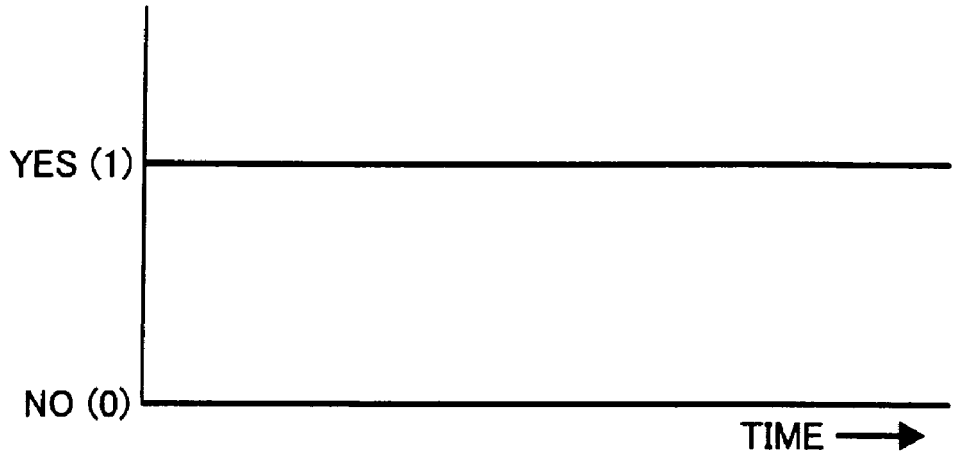
FIG. 17A illustrates a detection result of a sensor of the toner supplier shown in FIG. 11.
Figure 17B:
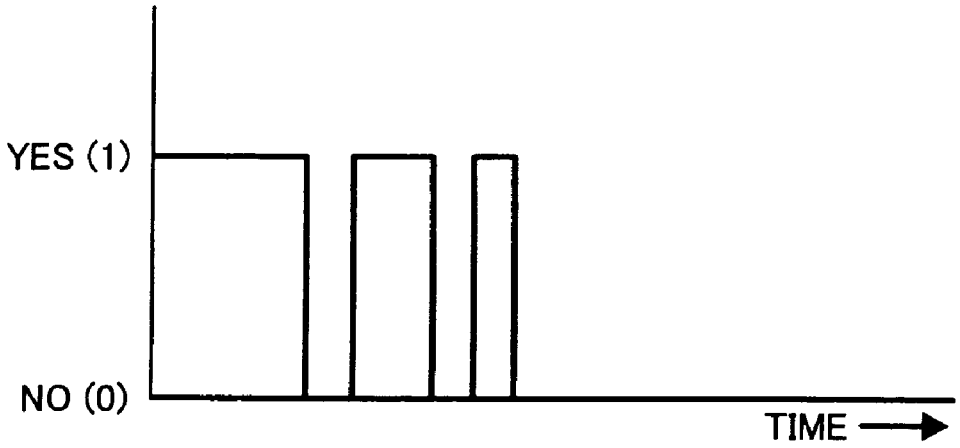
FIG. 17B illustrates a detection result of a sensor of the tester toner supplier shown in FIG. 15.

FIGS. 17A and 17B illustrate detection results of the sensor 72M when the sub hopper 48M contained a sufficient amount of toner and the conveying coil 70M rotated at about 124 rpm. FIG. 17A illustrates the detection result of the sensor 72M of the toner supplier 40M including the opening 75M. FIG. 17B illustrates the detection result of the sensor 72M of the tester toner supplier 40T not including the opening 75M. As illustrated in FIG. 17A, the sensor 72M of the toner supplier 40M has properly detected that the sub hopper 48M contained the sufficient amount of toner. As illustrated in FIG. 17B, however, the sensor 72M of the tester toner supplier 40T has erroneously detected that the sub hopper 48M did not contain the sufficient amount of toner.

The rotating speed of the driving motor 41M varies depending on torques of the agitator 74M, the conveying coil 70M, and the toner bottle 32M. Even when a signal instructing the driving motor 41M to output a common driving force is sent to the driving motor 41M, the rotating speed is slow when the driving motor 41M starts rotating and the torques are high. The rotating speed is high when the torques are low. Accordingly, the rotating speeds of the conveying coil 70M and the agitator 74M increase.

When the conveying coil 70M and the agitator 74M are rotated at about 124 rpm, the opening 75M provided on the agitator 74M prevented the toner from being excessively agitated and the sensor 72M did not erroneously detect that the sub hopper 48M was almost empty. When the agitator 74M rotated at about 155 rpm or faster, the sensor 72M erroneously detected that the sub hopper 48M was almost empty. When the agitator 74M rotated at about 155 rpm, the toner bottle 32M rotated at about 75 rpm.

Figure 18:
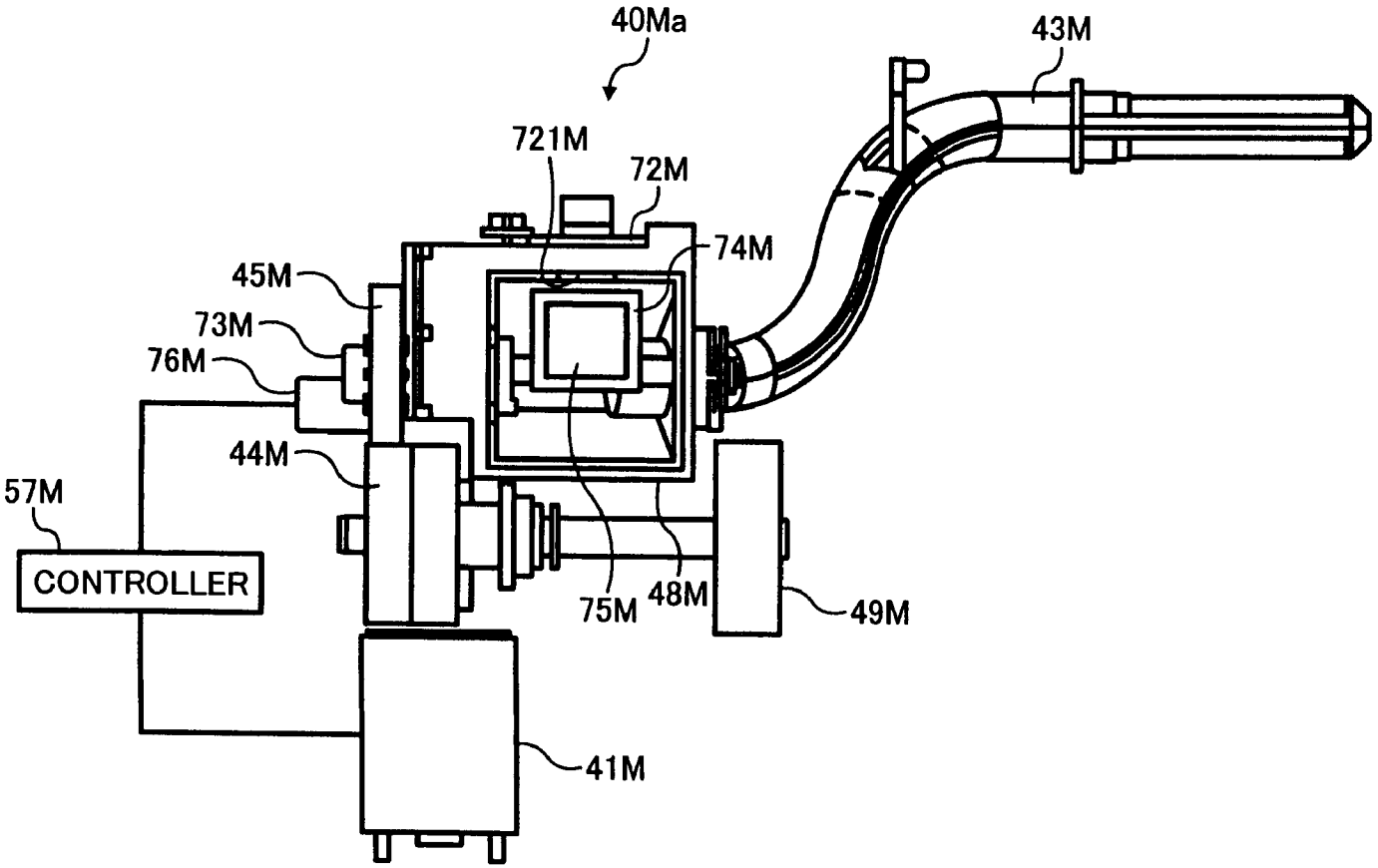
FIG. 18 is a sectional top view of a toner supplier according to another exemplary embodiment of the present invention.

FIG. 18 illustrates a toner supplier 40Ma according to another exemplary embodiment of the present invention. As illustrated in FIG. 18, the toner supplier 40Ma includes a counter 76M. The counter 76M and the controller 57M form a driving control mechanism for alternately driving and stopping the driving motor 41M and functioning as an agitation adjuster for adjusting the flowability of the toner in the sub hopper 48M. The other elements of the toner supplier 40Ma are common to the toner supplier 40M.

The counter 76M counts the number of revolutions per minute of the rotating shaft 73M and sends a signal based on the counted number of revolutions per minute of the rotating shaft 73M to the controller 57M. The controller 57M sends a signal based on the signal sent from the counter 76M to the driving motor 41M. The driving motor 41M performs intermittent driving (i.e., alternately drives and stops) based on the signal sent from the controller 57M.

When the number of revolutions per minute of the rotating shaft 73M counted by the counter 76M is about 155 rpm or more, the controller 57M controls the driving motor 41M to perform intermittent driving. While the driving motor 41M drives the agitator 74M, the toner is dispersed in the air in the sub hopper 48M. While the driving motor 41M stops driving the agitator 74M, the toner is not dispersed in the air, preventing the amount of toner per unit volume from decreasing. Thus, even when the number of revolutions per minute of the conveying coil 70M and the number of revolutions per minute of the agitator 74M increase, the sensor 72M may properly detect the toner at the detecting surface 721M. A duty ratio is represented by a time period of the drive to a total time period of the drive and the stop. In the toner supplier 40Ma, the duty ratio is controlled to be about 75 percent or less.

Figure 19A:
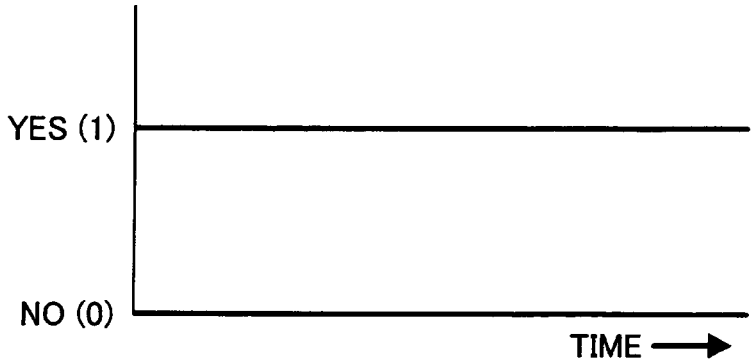
FIG. 19A illustrates a detection result of a sensor of the toner supplier shown in FIG. 18.
Figure 19B:
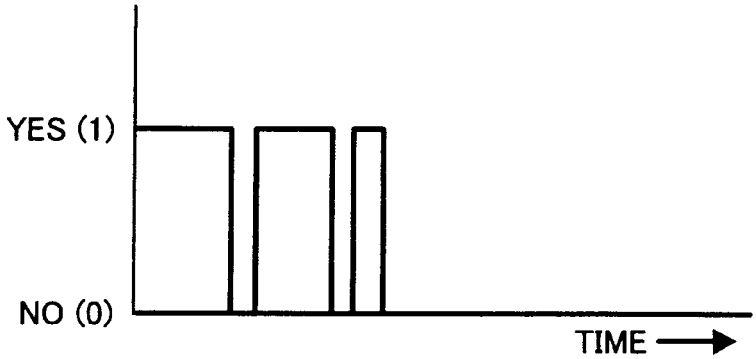
FIG. 19B illustrates another detection result of a sensor of the toner supplier shown in FIG. 18.
Figure 19C:
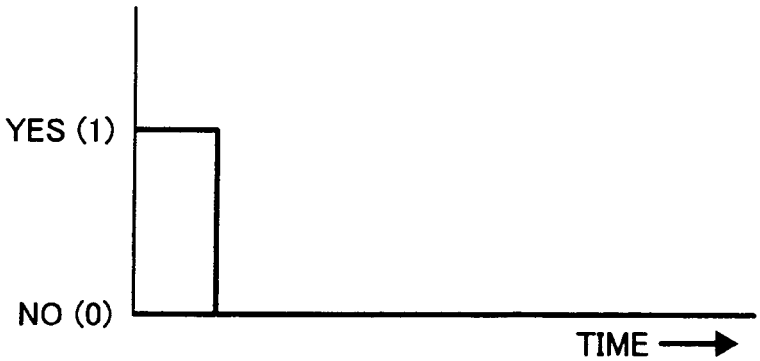
FIG. 19C illustrates yet another detection result of a sensor of the toner supplier shown in FIG. 18.

FIGS. 19A, 19B, and 19C illustrate detection results of the sensor 72M when the agitator 74M with the opening 75M rotated at about 155 rpm. FIG. 19A illustrates the detection result when the duty ratio was about 75 percent (i.e., when the driving motor 41M was turned on for about 1.5 seconds and was turned off for about 0.5 seconds). FIG. 19B illustrates the detection result when the duty ratio was about 90 percent (i.e., when the driving motor 41M was turned on for about 1.8 seconds and was turned off for about 0.2 seconds). FIG. 19C illustrates the detection result when the duty ratio was about 100 percent (i.e., when the driving motor 41M was continuously turned on).

As illustrated in FIG. 19A, when the driving motor 41M performed intermittent driving with the duty ratio of about 75 percent, the sensor 72M properly detected that the sub hopper 48M contained the sufficient amount of toner. As illustrated in FIG. 19B, when the driving motor 41M performed intermittent driving with the duty ratio of about 90 percent, the sensor 72M erroneously detected that the sub hopper 48M was almost empty. As illustrated in FIG. 19C, when the driving motor 41M continuously drove the agitator 74M, the sensor 72M erroneously detected that the sub hopper 48M was almost empty.

Figure 20:
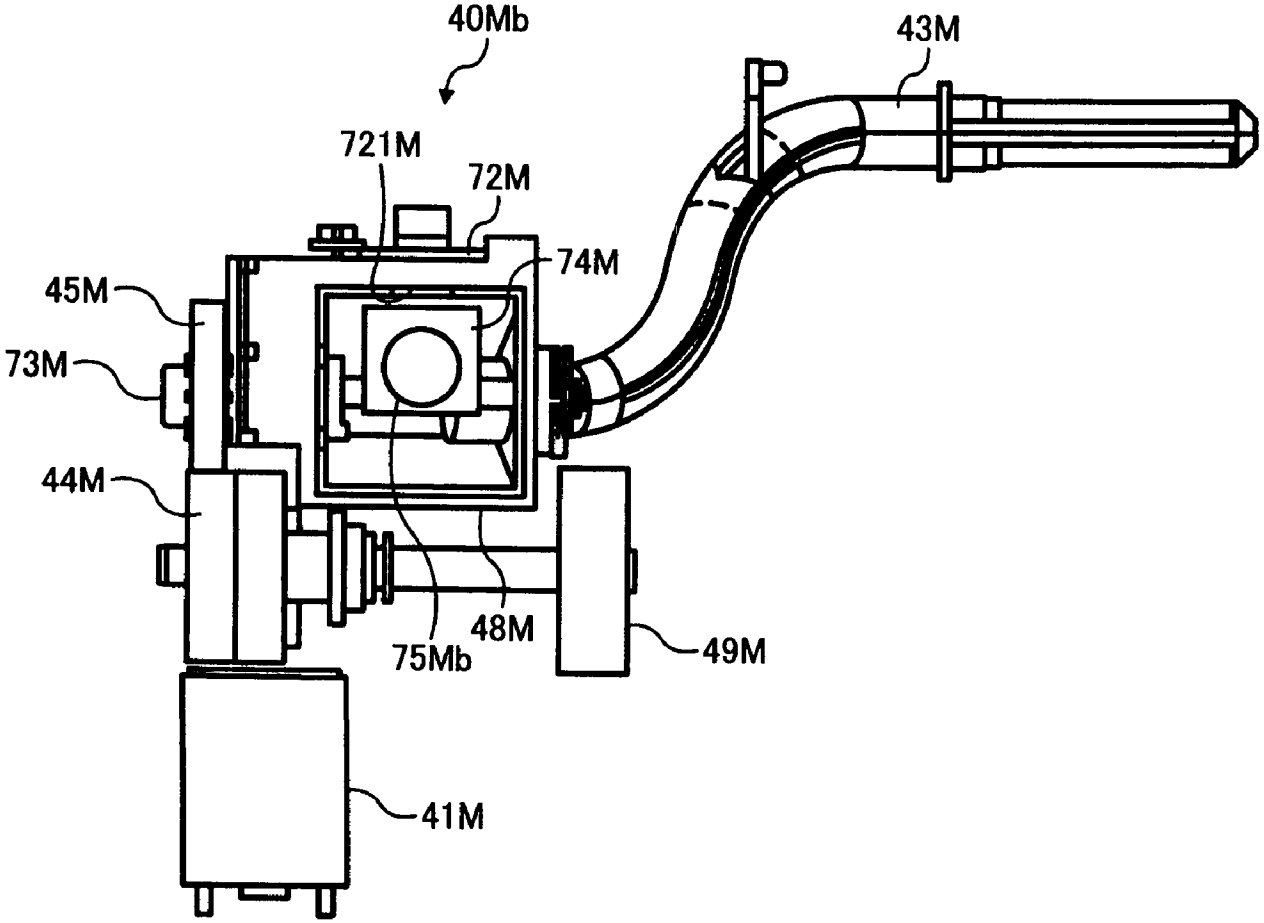
FIG. 20 is a sectional top view of a toner supplier according to yet another exemplary embodiment of the present invention.

FIG. 20 illustrates a toner supplier 40Mb according to yet another exemplary embodiment of the present invention. As illustrated in FIG. 20, the toner supplier 40Mb includes an opening 75Mb formed in a round-like shape. The other elements of the toner supplier 40Mb are common to the toner supplier 40M or 40Ma. The opening 75Mb may be formed in any shape other than the round-like shape as long as the opening 75Mb decreases a surface area of the agitator 74M used for agitating the toner.

According to the above-described non-limiting exemplary embodiments of the present invention, the toner supplier 40M, 40Ma, or 40Mb includes the sub hopper 48M as a developer container for containing toner to be supplied to the development unit 5M, the conveying coil 70M as a conveyer for conveying the toner to the developer container 54M of the development unit 5M, the sensor 72M for detecting the toner in the sub hopper 48M, the agitator 74M as an agitator for agitating the toner in the sub hopper 48M, and the driving motor 41M as a driver for driving the agitator 74M and the conveying coil 70M. The opening 75M or 75Mb is provided on the agitator 74M. When the agitator 74M rotates to agitate the toner in the sub hopper 48M, the toner slips through the opening 75M or 75Mb. Thus, the agitation of the agitator 74M may be adjusted to prevent the toner from being excessively agitated by the agitator 74M. As a result, the toner may not be excessively dispersed in the air in the sub hopper 48M and the amount of toner per unit volume may not be partially decreased. Thus, even when the number of revolutions per minute of each of the conveying coil 70M and the agitator 74M is increased, the sensor 72M may properly detect the toner at the detecting surface 721M.

The agitator 74M scrapes the detecting surface 721M of the sensor 72M to prevent the toner from adhering to the detecting surface 721M so as to reduce or prevent an erroneous detection of the sensor 72M which may occur due to the toner adhered to the detecting surface 721M.

The flexible material, such as the PET, included in the agitator 74M may suppress abrasion and wear of the detecting surface 721M more effectively than the inflexible material such as the metal.

The length from the rotating shaft 73M to the foremost end of the agitator 74M is longer than the distance from the rotating shaft 73M to the detecting surface 721M. Thus, the foremost end of the agitator 74M may properly scrape the detecting surface 721M in a state that the foremost end of the agitator 74M is engaged in the detecting surface 721M. The width of the agitator 74M is greater than the width of the detecting surface 721M. Therefore, the agitator 74M may properly scrape the whole width of the detecting surface 721M. The agitator 74M, which scrapes the detecting surface 721M, may prevent the toner from adhering to the detecting surface 721M and may thereby prevent an erroneous detection of the sensor 72M which may occur due to the toner adhered to the detecting surface 721M.

The agitator 74M rotates to scrape the detecting surface 721M upward. The agitator 74M pushes back the toner falling onto the agitator 74M. The agitator 74M guards the detecting surface 721M from the toner immediately after the agitator 74M scrapes the detecting surface 721M. Thus, the cleaned detecting surface 721M may be maintained. If the agitator 74M rotates to scrape the detecting surface 721M downward, the detecting surface 721M is exposed to the falling toner immediately after the agitator 74M scrapes the detecting surface 721M. The falling toner adheres to the cleaned detecting surface 721M. Thus, the cleaned detecting surface 721M may not be maintained.

The rotating shaft 73M for rotating the agitator 74M is disposed horizontally (i.e., in a direction perpendicular to a direction in which the toner moves downward in the sub hopper 48M). If the toner bottle 32M contains a toner having a high flowability, a substantial amount of toner may be put into the empty toner supplier 40M, 40Ma, or 40Mb, for example, when the image forming apparatus 100 is set up. Namely, gravity causes an unexpected amount of toner to be flown into the toner supplier 40M, 40Ma, or 40Mb. In this case, the rotating shaft 73M and the agitator 74M disposed in the direction perpendicular to the direction in which the toner moves downward in the sub hopper 48M may interrupt the movement of the toner more easily than the rotating shaft 73M and the agitator 74M disposed in parallel to the direction in which the toner moves downward in the sub hopper 48M. Thus, a substantial amount of toner may not flow into the sub hopper 48M in a given time period.

The toner supplier 40Ma or 40Mb further includes the driving control mechanism. When the agitator 74M rotates at about 155 rpm or more, the driving control mechanism causes the driving motor 41M to perform intermittent driving (i.e., to alternately drive and stop). Even when the number of revolutions per minute of the agitator 74M increases to the extent that the opening 75M or 75*b* may not suppress the flowability of the toner in the sub hopper 48M, the toner is not dispersed into the air in the sub hopper 48M while the agitator 74M stops. Thus, the agitation of the agitator 74M may be suppressed. Namely, even when the number of revolutions per minute of each of the conveying coil 70M and the agitator 74M is increased, the sensor 72M may properly detect the toner at the detecting surface 721M.

When the toner having a high flowability (e.g., an accelerated agglomeration of about 15 percent or lower) is used, the toner may be stably conveyed in the toner supplier 40M, 40Ma, or 40Mb.

The conveying coil 70M is formed in a coil-like shape which is not easily stressed by bending. The conveying coil 70M may be coiled even if the pipe 43M is bended. Therefore, the pipe 43M needs not be formed in a straight shape, providing an increased flexibility in the layout of elements in the development unit 5M. As a result, the development unit 5M may have a compact size.

The conveying coil 70M is disposed in the lower portion of the sub hopper 48M. The toner is supplied into the sub hopper 48M from the upper portion of the sub hopper 48M and the weight of the toner moves the toner downward to the lower portion of sub hopper 48M. Therefore, no toner conveyer for conveying the toner from the upper portion to the lower portion of the sub hopper 48M needs to be provided in the sub hopper 48M.

The rotating shafts 71M and 73M are not disposed parallel with each other. The rotating shaft 71M slants in a manner such that a downstream portion of the rotating shaft 71M in the toner conveyance direction is disposed downwardly. Therefore, the toner may easily move toward the downstream portion of the rotating shaft 71M in the toner conveyance direction, resulting in a stable conveyance of the toner. The rotating shafts 71M and 73M respectively include the conveyer bevel gear 47M and the agitator bevel gear 46M. Therefore, even when the rotating shafts 71M and 73M are not disposed parallel with each other, the driving force from the driving motor 41 may be transmitted to the rotating shafts 71M and 73M via the conveyer bevel gear 47M and the agitator bevel gear 46M.

The conveyer bevel gear 47M and the agitator bevel gear 46M have the common number of gear teeth. One of the conveyer bevel gear 47M and the agitator bevel gear 46M needs not be larger than the other, saving space in the toner supplier 40M, 40Ma, or 40Mb. The conveyer bevel gear 47M and the agitator bevel gear 46M may be formed so as to have a common shape, resulting in decreased production costs.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

The invention claimed is:

1. A developer supplier for supplying a developer to an image forming mechanism, comprising:

a developer container configured to contain the developer;

a conveyer configured to convey the developer from the developer container to the image forming mechanism;

a sensor disposed at a predefined position on an interior wall of the developer container and configured to detect the developer at the predefined position in the developer container;

an agitator configured to rotate and to agitate the developer, and including a paddle formed in a plate-like shape and including an opening through which a part of the developer slips and avoids being paddled by the paddle; and a driver configured to drive the conveyer and the agitator at a variable speed.

2. An image forming apparatus, comprising:

an image forming mechanism configured to contain a developer and to form an image with the developer; and a developer supplier configured to supply the developer to the image forming mechanism, and including a developer container configured to contain the developer, a conveyer configured to convey the developer from the developer container to the image forming mechanism, a sensor disposed at a predefined position on an interior wall of the developer container and configured to detect the developer at the predefined position in the developer container, an agitator configured to rotate to agitate the developer, and including a paddle formed with a plate-like shape and including an opening through which a part of the developer slips and avoids being paddled by the paddle, and a driver configured to drive the conveyer and the agitator at a variable speed.

3. An image forming apparatus, comprising:

an image forming mechanism configured to contain a developer and to form an image with the developer; and a developer supplier configured to supply the developer to the image forming mechanism, and including a developer container configured to contain the developer, a conveyer configured to convey the developer from the developer container to the image forming mechanism, a sensor disposed at a predefined position on an interior wall of the developer container and configured to detect the developer at the predefined position in the developer container, an agitator configured to rotate and to agitate the developer, a driver configured to drive the conveyer and the agitator at a variable speed, and an agitation adjuster configured to suppress an increase in flowability of the developer increased by agitation thereof by the agitator.

4. The image forming apparatus according to claim 3, wherein the agitation adjuster includes a driving control mechanism configured to alternately drive and stop the driver in accordance with rotational speed of the agitator.

5. The image forming apparatus according to claim 3, wherein the agitator includes a paddle formed in a plate-like shape, said paddle including an opening through which a part of the developer slips and avoids being paddled by the paddle.

6. The image forming apparatus according to claim 4, wherein the driving control mechanism alternately drives and stops the driver at a specific duty ratio of not greater than about 75 percent, the specific duty ratio being of a time period of the drive to a total time period of the drive and the stop.

7. The image forming apparatus according to claim 2, wherein the agitator includes a flexible material.

8. The image forming apparatus according to claim 7, wherein the sensor includes a detecting surface and the agitator scrapes the detecting surface.

9. The image forming apparatus according to claim 8, wherein the developer supplier further includes a first rotating shaft for supporting and rotating the agitator, and wherein the agitator has a length greater than a distance from the first rotating shaft to the detecting surface of the sensor and a width greater than the detecting surface of the sensor.

10. The image forming apparatus according to claim 9, wherein the agitator scrapes the detecting surface of the sensor upward.

11. The image forming apparatus according to claim 9, wherein the first rotating shaft extends in a direction perpendicular to a direction in which the developer moves in the developer container.

12. The image forming apparatus according to claim 2, wherein an accelerated agglomeration of the developer is not greater than about 15 percent.

13. The image forming apparatus according to claim 9, wherein the developer supplier further includes a second rotating shaft for supporting and rotating the conveyer, and wherein the conveyer is formed in a coil-like shape and rotates to convey the developer in a direction in which the second rotating shaft extends.

14. The image forming apparatus according to claim 2, wherein the conveyer is disposed in a lower portion of the developer container and the developer is supplied from an upper portion of the developer container.

15. The image forming apparatus according to claim 13, wherein the developer supplier further includes a first gear disposed on the first rotating shaft and a second gear disposed on the second rotating shaft and the first and second gears are engaged with each other to transmit a driving force, and wherein the second rotating shaft is nonconcurrently disposed with respect to the first rotating shaft.

16. The image forming apparatus according to claim 15, wherein the first and second gears have a common number of gear teeth.

* * * * *